US008449437B1

(12) United States Patent
Maresh et al.

(10) Patent No.: US 8,449,437 B1
(45) Date of Patent: May 28, 2013

(54) EXERCISE METHODS AND APPARATUS

(76) Inventors: Joseph D Maresh, West Linn, OR (US); Kenneth W Stearns, Houston, TX (US)

( * ) Notice: Subject to any disclaimer, the term of this patent is extended or adjusted under 35 U.S.C. 154(b) by 0 days.

(21) Appl. No.: 12/628,208

(22) Filed: Nov. 30, 2009

Related U.S. Application Data

(63) Continuation-in-part of application No. 12/389,370, filed on Feb. 19, 2009, now Pat. No. 7,811,207.

(60) Provisional application No. 61/066,287, filed on Feb. 19, 2008.

(51) Int. Cl.
*A63B 22/04* (2006.01)

(52) U.S. Cl.
USPC ..... 482/52; 482/70

(58) Field of Classification Search
USPC ..... 482/51, 52, 53, 57, 70, 79, 80, 62, 482/71, 148; 434/247, 255; D21/668, 670
See application file for complete search history.

(56) References Cited

U.S. PATENT DOCUMENTS

| | | | | |
|---|---|---|---|---|
| 6,077,198 | A * | 6/2000 | Eschenbach | 482/52 |
| 6,277,054 | B1 * | 8/2001 | Kuo | 482/51 |
| 6,440,042 | B2 * | 8/2002 | Eschenbach | 482/52 |
| 6,612,969 | B2 * | 9/2003 | Eschenbach | 482/51 |
| 6,620,079 | B2 * | 9/2003 | Kuo | 482/51 |
| 6,672,992 | B1 * | 1/2004 | Lo et al. | 482/52 |
| 6,994,656 | B2 * | 2/2006 | Liao et al. | 482/52 |
| 7,060,004 | B2 * | 6/2006 | Kuo | 482/52 |
| 7,104,929 | B1 * | 9/2006 | Eschenbach | 482/52 |
| 7,201,706 | B1 * | 4/2007 | Lee et al. | 482/52 |
| 7,455,624 | B2 * | 11/2008 | Liao Lai | 482/51 |
| 7,608,018 | B2 * | 10/2009 | Chuang et al. | 482/52 |
| 2006/0166791 | A1 * | 7/2006 | Liao et al. | 482/52 |
| 2008/0261778 | A1 * | 10/2008 | Chuang et al. | 482/52 |
| 2009/0048077 | A1 * | 2/2009 | Chuang et al. | 482/62 |
| 2009/0111663 | A1 * | 4/2009 | Kuo | 482/53 |

* cited by examiner

*Primary Examiner* — Stephen Crow
(74) *Attorney, Agent, or Firm* — Nick A. Nichols, Jr.

(57) ABSTRACT

An exercise apparatus links rotation of a crank to generally elliptical motion of a foot supporting member. A foot supporting linkage is movably connected between a rocker and a crank in such a manner that the foot supporting member moves through paths of motion which are fixed, adjustable or variable.

1 Claim, 34 Drawing Sheets

242
267
270
285
291
265
260
245
293
273
270
241
250
282
282
287
298
240
253
220
230
243
240
253

242
267
241
245
260
293
270
291
250
282
250
240
287
298
240
253
133
210
215
221
133

242
265
260
241
285
270
267
241
245
298
291
293
273
250
282
282
253
221
210
220
222
240
215
243
299

367
395
392
382
341
344
370
360
398
350
340
330
310
315
336
333
321

442
492
484
495
465
493
460
441
452
440
422
467
450

405
492
484
493
467
441
441
445
452
482
498
450
440
453
430

410
433
442
436
444
440
442
430
430
484
493
492
482
460
440
450
452
498
450
499
460
493
420
422

EXERCISE METHODS AND APPARATUS

CROSS-REFERENCE TO RELATED APPLICATION

This application is a continuation-in-part application of U.S. patent application Ser. No. 12/389,370, filed Feb. 19, 2009 now U.S. Pat. No. 7,811,207, which claims the benefit of U.S. Provisional Application Ser. No. 61/066,287, filed Feb. 19, 2008, which applications are incorporated herein by reference.

BACKGROUND OF THE INVENTION

The present invention relates to fitness machines, and in particular a fitness machine which constrains the user's foot and/or arm to travel along a variable or fixed foot path.

Exercise equipment has been designed to facilitate a variety of exercise motions (including treadmills for walking or running in place; stepper machines for climbing in place; bicycle machines for pedaling in place; and other machines for skating and/or striding in place. Yet another type of exercise equipment has been designed to facilitate relatively more complicated exercise motions and/or to better simulate real life activity. Such equipment converts a relatively simple motion, such as circular, into a relatively more complex motion, such as elliptical. Despite various advances in the elliptical exercise category, room for improvement remains.

SUMMARY OF THE INVENTION

The present invention may be seen to provide a novel linkage assembly and corresponding exercise apparatus suitable for linking circular motion to relatively more complex, generally elliptical motion. Left and right cranks are rotatably mounted on a frame. A foot supporting linkage is movably connected between a rocker and the left and right cranks in such a manner that the foot supporting member moves through paths of motion which are fixed, adjustable or variable.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION OF PREFERRED EMBODIMENTS

Figure 1:
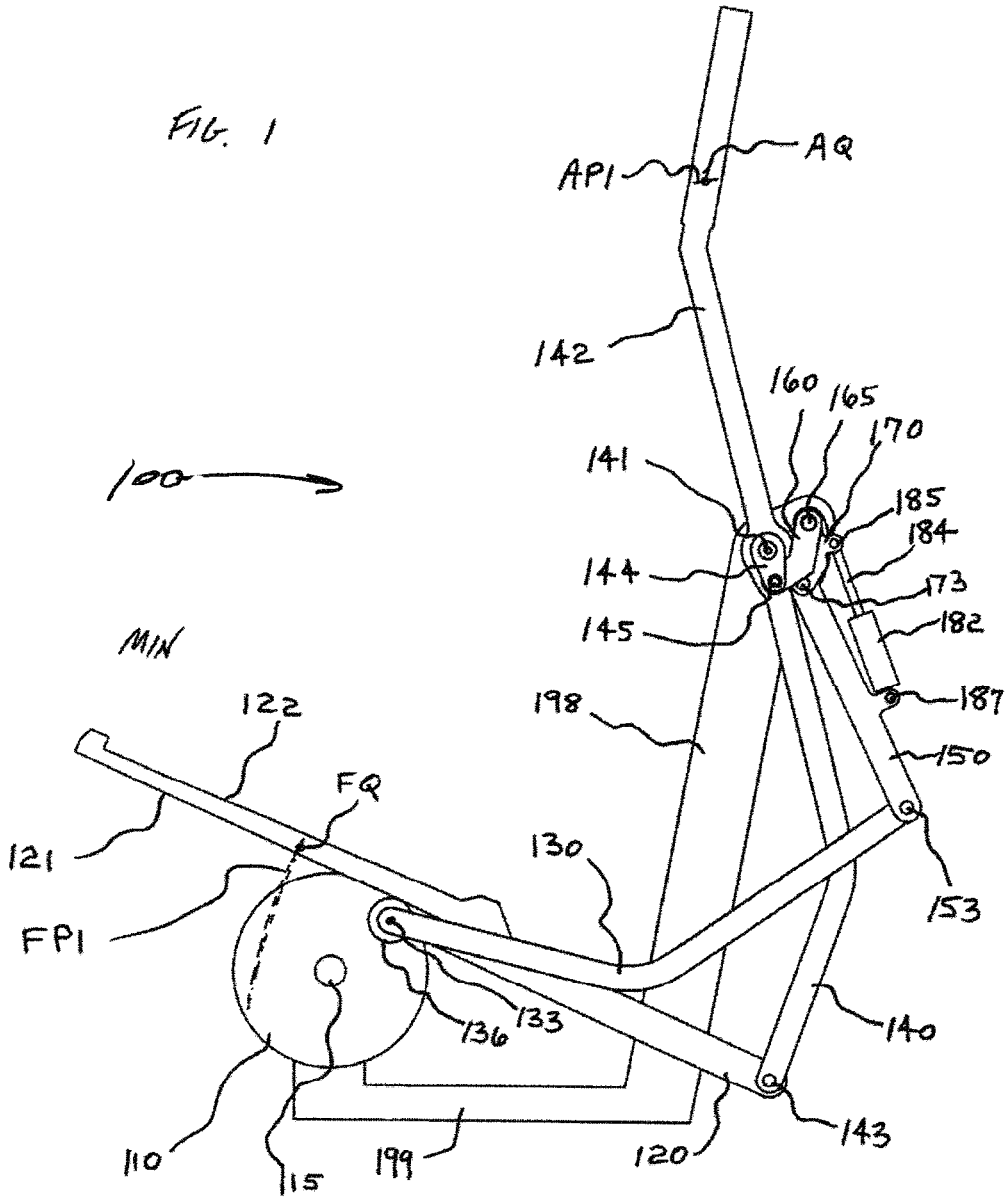
FIG. 1 is a side view of a first embodiment of the exercise apparatus of the present invention.

The present invention provides elliptical motion exercise machines or apparatus which link rotation of left and right cranks to generally elliptical motion of respective left and right foot supports. The term "elliptical motion" is intended in a broad sense to describe a closed path of motion having a relatively longer major axis and a relatively shorter minor axis. In general, the present invention may be said to use displacement of the cranks to move the foot supports in a direction coincidental with one axis of the elliptical path, and displacement of crank driven members to move the foot supports in a direction coincidental with the other axis. A general characteristic of the present invention is that the crank diameter determines the length of one axis, but does not determine the length of the other axis. As a result of this feature, a person's feet may pass through a space between the cranks while nonetheless traveling through a generally elliptical path having a desirable aspect ratio, and the machines that embody this technology may be made relatively more compact, as well. The embodiments shown and/or described herein are generally symmetrical about a vertical plane extending lengthwise through a floor-engaging base (perpendicular to the transverse ends thereof). In general, the "right-hand" components are one hundred and eighty degrees out of phase relative to the "left-hand" components. However, like reference numerals are used to designate both the "right-hand" and "left-hand" parts, and when reference is made to one or more parts on only one side of an apparatus, it is to be understood that corresponding part(s) are disposed on the opposite side of the apparatus. Also, to the extent that reference is made to forward or rearward portions of an apparatus, it is to be understood that a person can typically exercise on such apparatus while facing in either direction relative to the linkage assembly.

Referring first to FIGS. 1-4, a first embodiment of the present invention is generally identified by the reference numeral 100. Referring particularly to FIG. 1, a frame 199 rotatably supports a crank disk 110 at crank axle 115. A handle bar rocker 140 is rotatably connected to a front stanchion 198 of the frame 199 at shaft 141. A handle bar 142 is rigidly connected to the handle bar rocker 140. A lower distal end of the handle bar rocker 140 is rotatably connected to a forward distal end of a longitudinal foot member 120 at shaft 143. A foot platform 122 is rigidly connected to the foot member 120. A crank roller 136 is rotatably secured to a crank shaft 133 and supports the foot member 120 thereon. The crank roller 136 is generally in rolling contact with a race 121 of the foot member 120.

Referring still to FIG. 1, a rearward distal end of a drawbar 130 is rotatably connected to the crank shaft 133, and a forward distal end of the drawbar 130 is rotatably connected to a lower distal end of a drawbar rocker 150 at shaft 153. An upper distal end of the drawbar rocker 150 is rotatably connected to the stanchion 198 at a shaft 165. A first intermediate link 160 has a first end rotatably connected to the handle bar rocker 140 at shaft 145. A lobe 144 rigidly connected with the handle bar rocker 140 (and handle bar 142), is provided for spatial purposes as will be evident in other illustrations shown and described latter herein. Continuing now, a second intermediate link 170 has a first end rotatably connected to the drawbar rocker 150 at shaft 173. A second end of the first intermediate link 160 is rotatably connected to a second end of the second intermediate link 170 at the shaft 165. In order to provide adjustability of foot path FP1, a rod end 184 of an actuator 182 is rotatably connected to the second intermediate link 170 at shaft 185. The base end of the actuator 182 is rotatably connected to the drawbar rocker 150 at shaft 187. It is understood that the actuator 182 alternatively may be a motor which adjusts the distance between shafts 185 and 187, or some form of spring, damper, and/or some combination of spring-damper, or other mechanism which allows the user in one instance to manually adjust the stride length, or have the stride length vary as a function of user applied force. In the former instance, a computer program may effect a change in the stride length as part of an interactive program, or during the course of responding to signals from strain gauges and the like which may be incorporated into the exercise apparatus 100 for purposes of variable and responsive foot path changes. It is further understood that signal(s) may be utilized at other electrical components of the exercise apparatus 100, for example, at an electronic brake which may in turn effect a variation in the foot stride length.

Figure 4A:
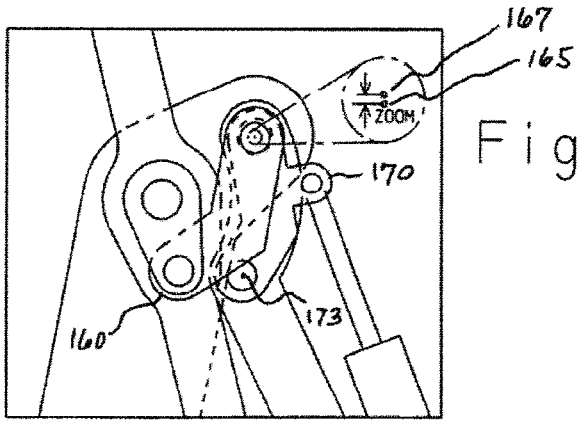
FIG. 4*a*, FIG. 4*b* and FIG. 4*c* are enlarged fragmentary side views depicting the position of the adjustment mechanism respectively corresponding to the first embodiment of the present invention illustrated in FIG. 1, FIG. 2 and FIG. 3.

Continuing with FIG. 1, it will be observed that point FQ affixed to the foot platform 122 scribes a foot path FP1, wherein the foot path FP1 has a minimal longitudinal component. In order to create this minimal foot path, the actuator rod 184 is extended so that the axis of the shaft 165 nearly approaches the axis of the shaft 167, as best shown in FIG. 4*a*. Referring still to FIG. 1, it will be observed that the arm path AP1 corresponds to the foot path FP1. That is, if the corresponding foot path FP1 is minimal, the arm path AP1 is also minimal. The arm member 142 may alternatively be rigidly connected to the drawbar rocker 150 (not shown in the drawings), in which case the arm path AP1 would not be variable.

Figure 2:
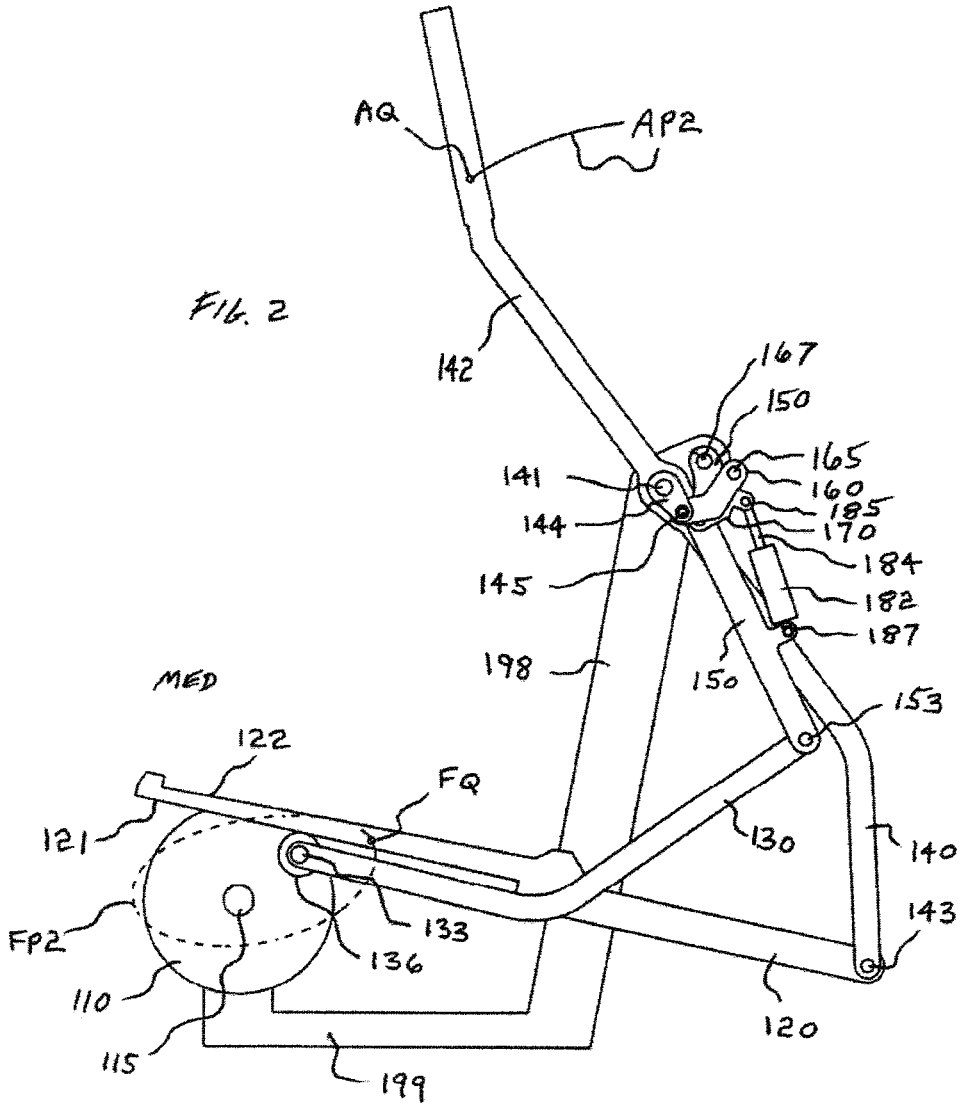
FIG. 2 is a side view of the exercise apparatus of FIG. 1 adjusted for a medium longitudinal foot path.
Figure 4B:
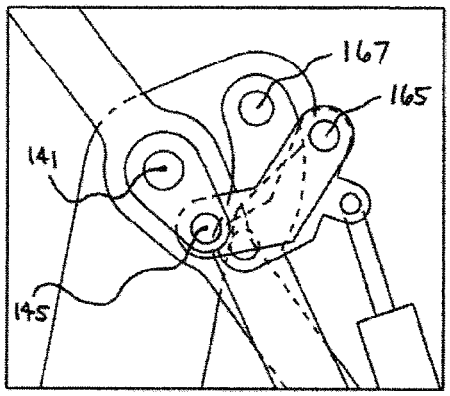

Directing attention now to FIG. 2, the actuator rod 184 is shown partially retracted which consequently moved the axis of shaft 165 away from the axis of shaft 167, as best shown in FIG. 4*b*, thereby establishing a medium foot path FP2 and a medium arm path AP2.

Figure 3:
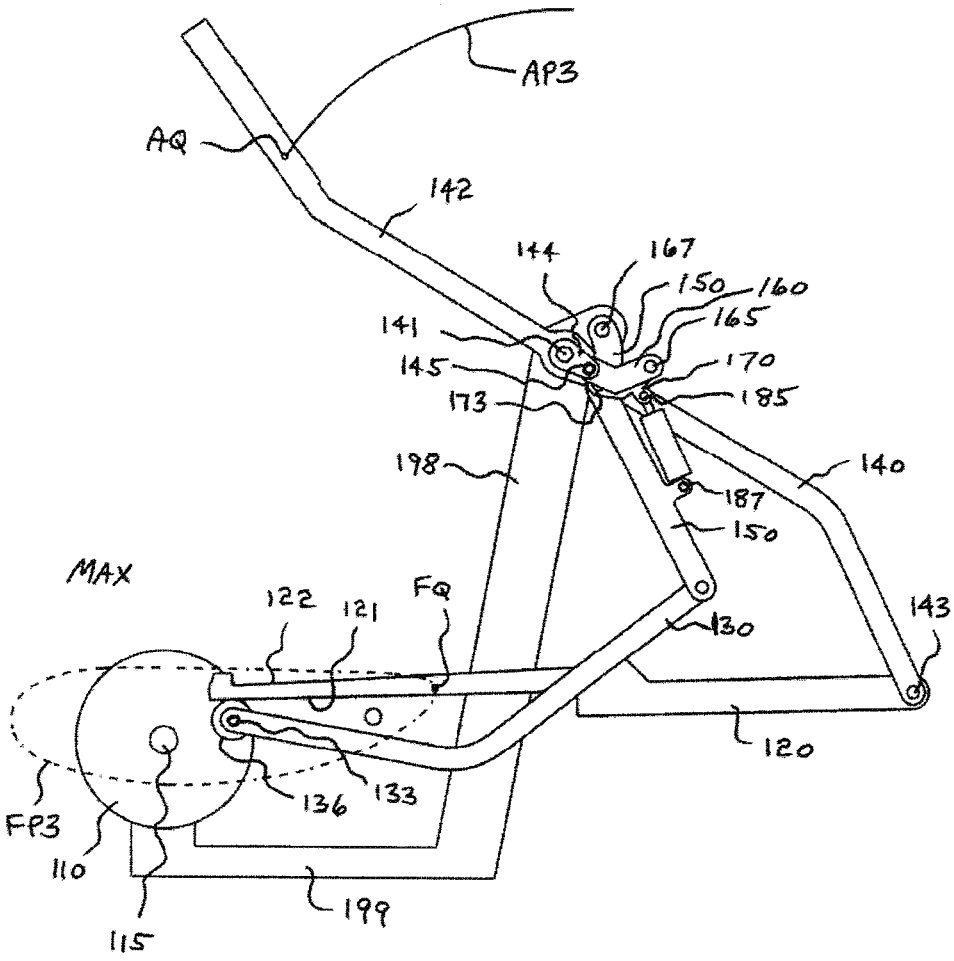
FIG. 3 is a side view of the exercise apparatus of FIG. 1 adjusted for a maximum longitudinal foot path.
Figure 4C:
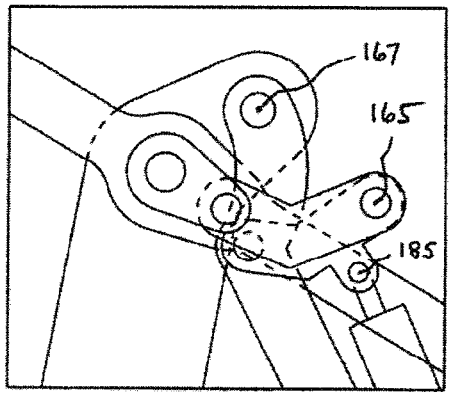
Figure 5:
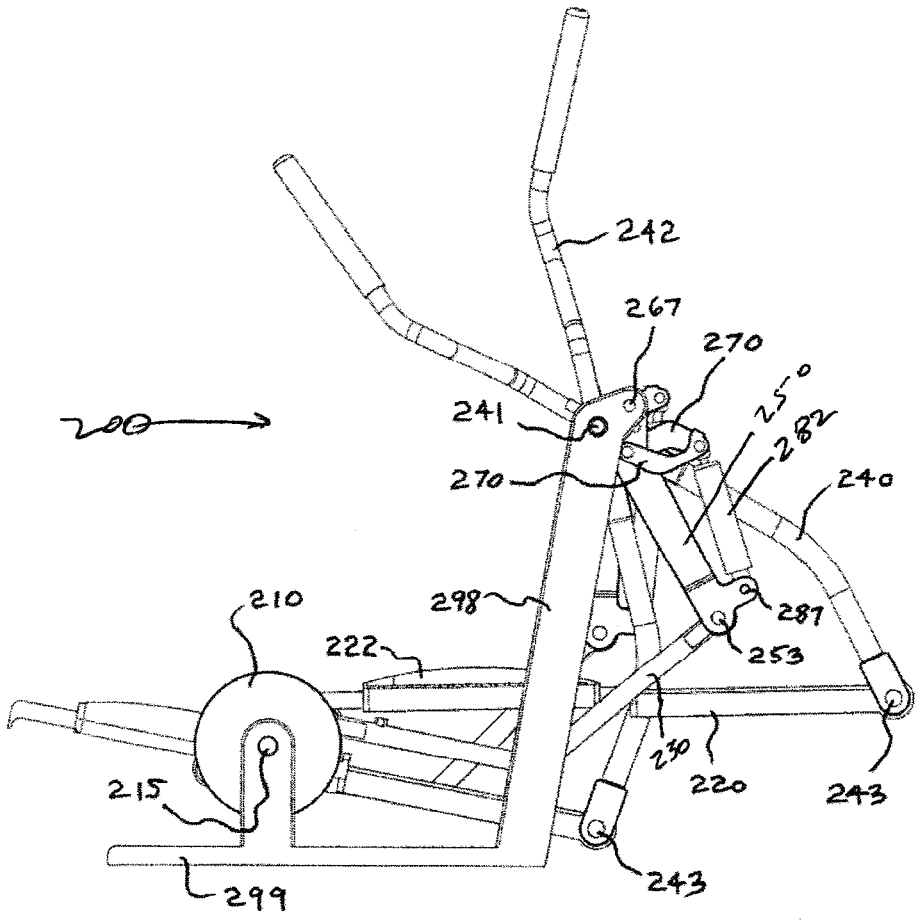
FIG. 5 is a side view of a second embodiment of the present invention.
Figure 6:
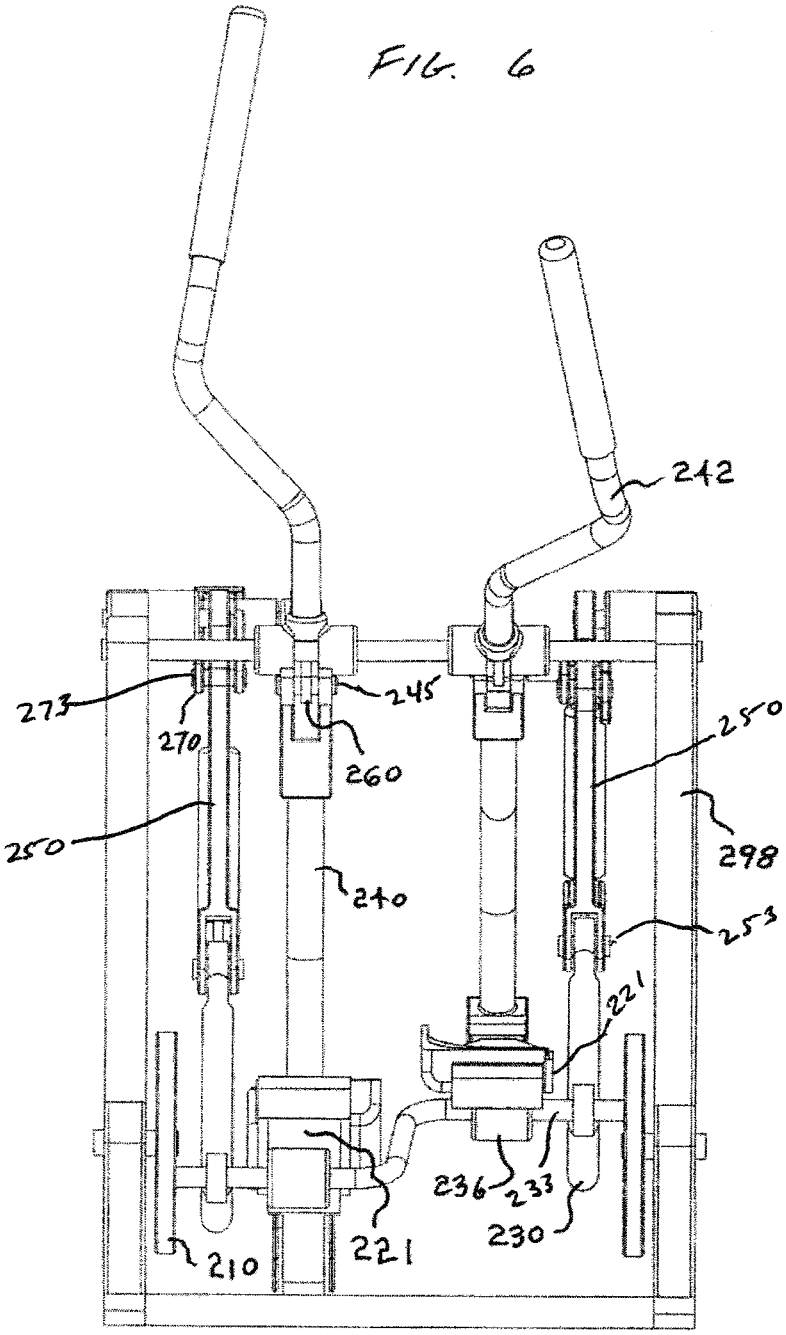
FIG. 6 is a rear view of the exercise apparatus of FIG. 5.
Figure 7:
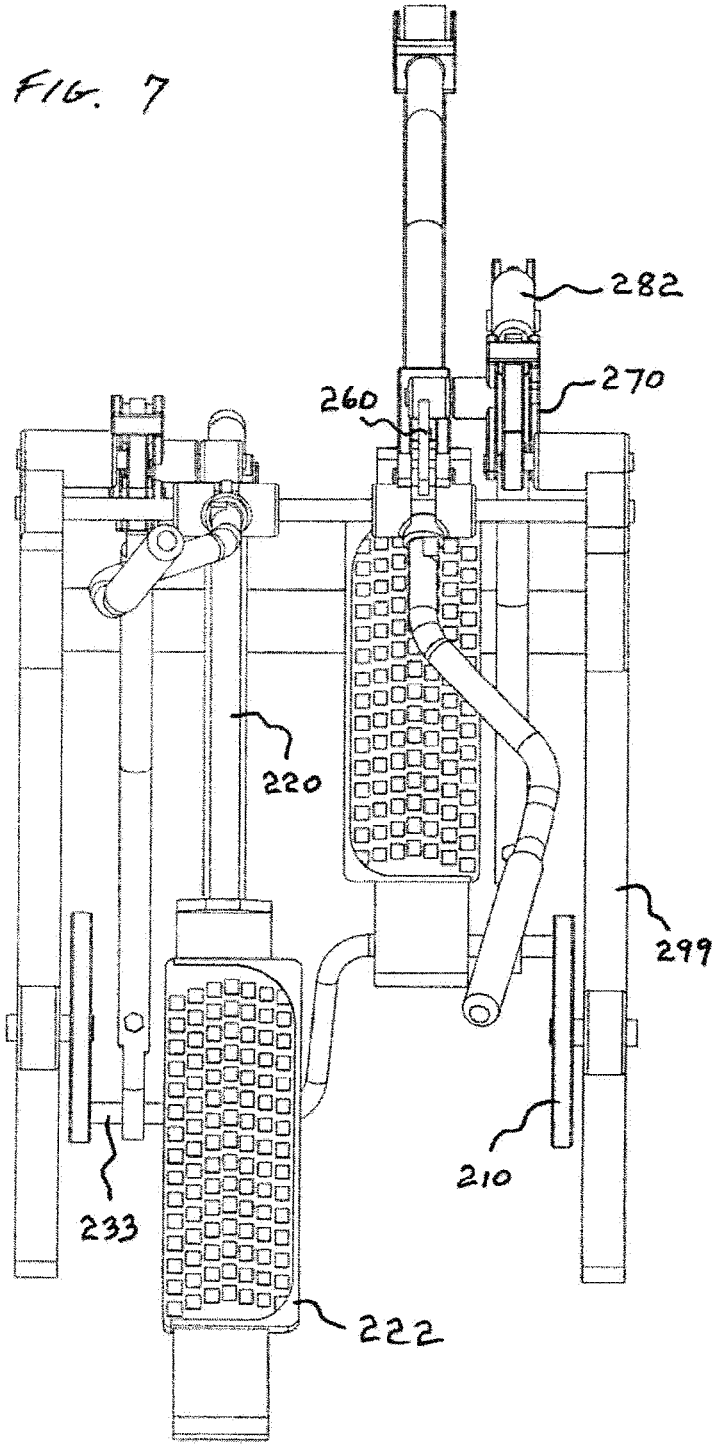
FIG. 7 is a top view of the exercise apparatus of FIG. 5.

Referring now to FIG. 3, the actuator rod 184 is shown fully retracted which consequently moves the axis of shaft 165 furthest away from the axis of shaft 167, as best shown in FIG. 4*c*, thereby establishing a maximum foot path FP3 and a maximum arm path AP3.

Directing attention now to FIGS. 5-11, a second embodiment of the present invention is generally identified by the reference numeral 200. The exercise apparatus 200 closely resembles the exercise apparatus 100 shown in FIGS. 1-4. A frame 299 rotatably supports a crank disk 210 at a crank axle 215. A handle bar rocker 240 is rotatably connected to a stanchion 298 of the frame 299 at shaft 241. A handle bar 242 is rigidly connected to the handle bar rocker 240. A lower distal end of the handle bar rocker 240 is rotatably connected to a forward distal end of a longitudinal foot member 220 at shaft 243. A foot platform 222 is rigidly connected to the foot member 220. A crank roller 236 is rotatably secured to a crank shaft 233, and supports the foot member 220. The crank roller 236 is generally in rolling contact with a race 221 of the foot member 220.

Figure 8:
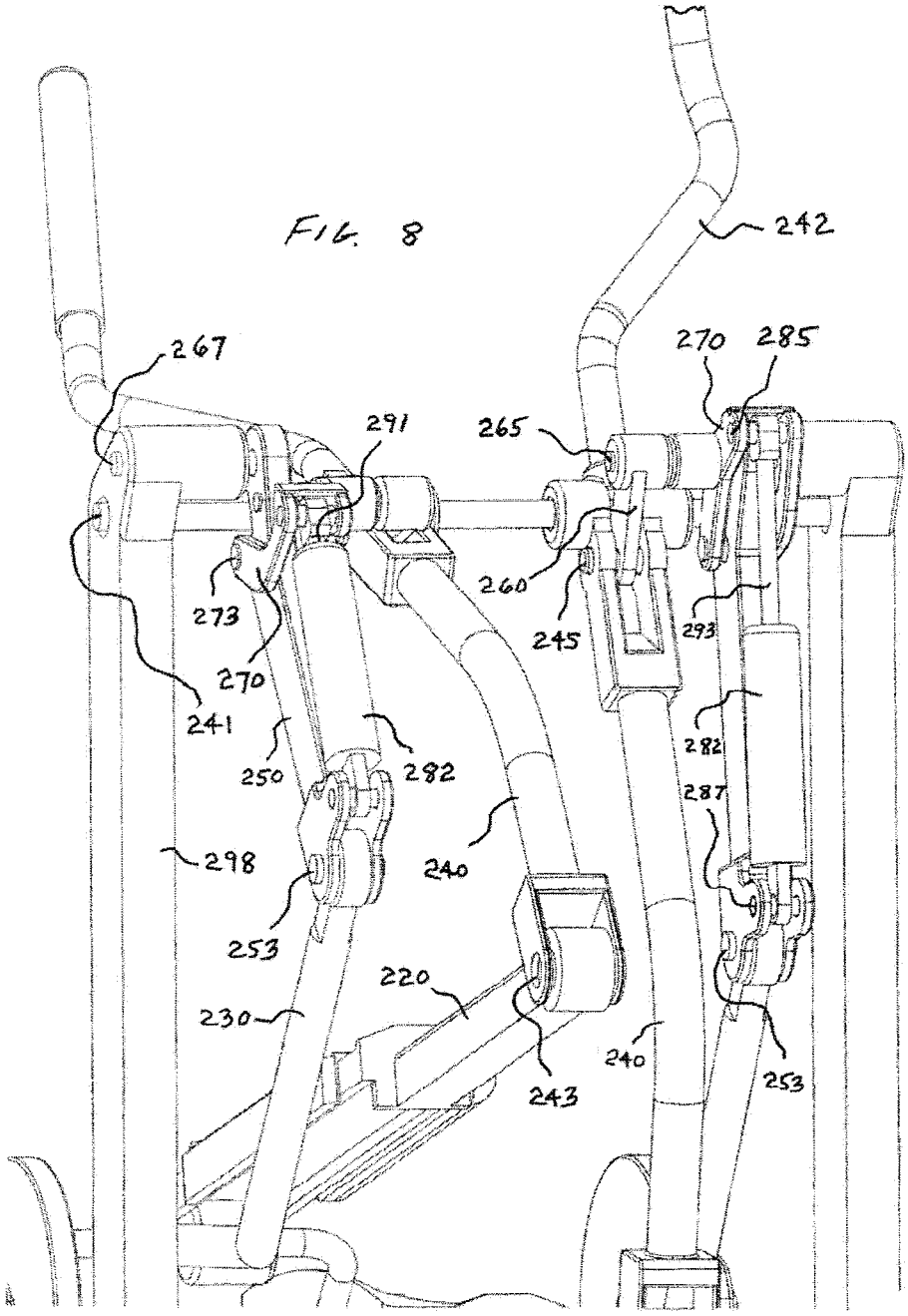
FIG. 8 is an enlarged fragmentary perspective view taken from the front of the exercise apparatus of FIG. 5.
Figure 9:
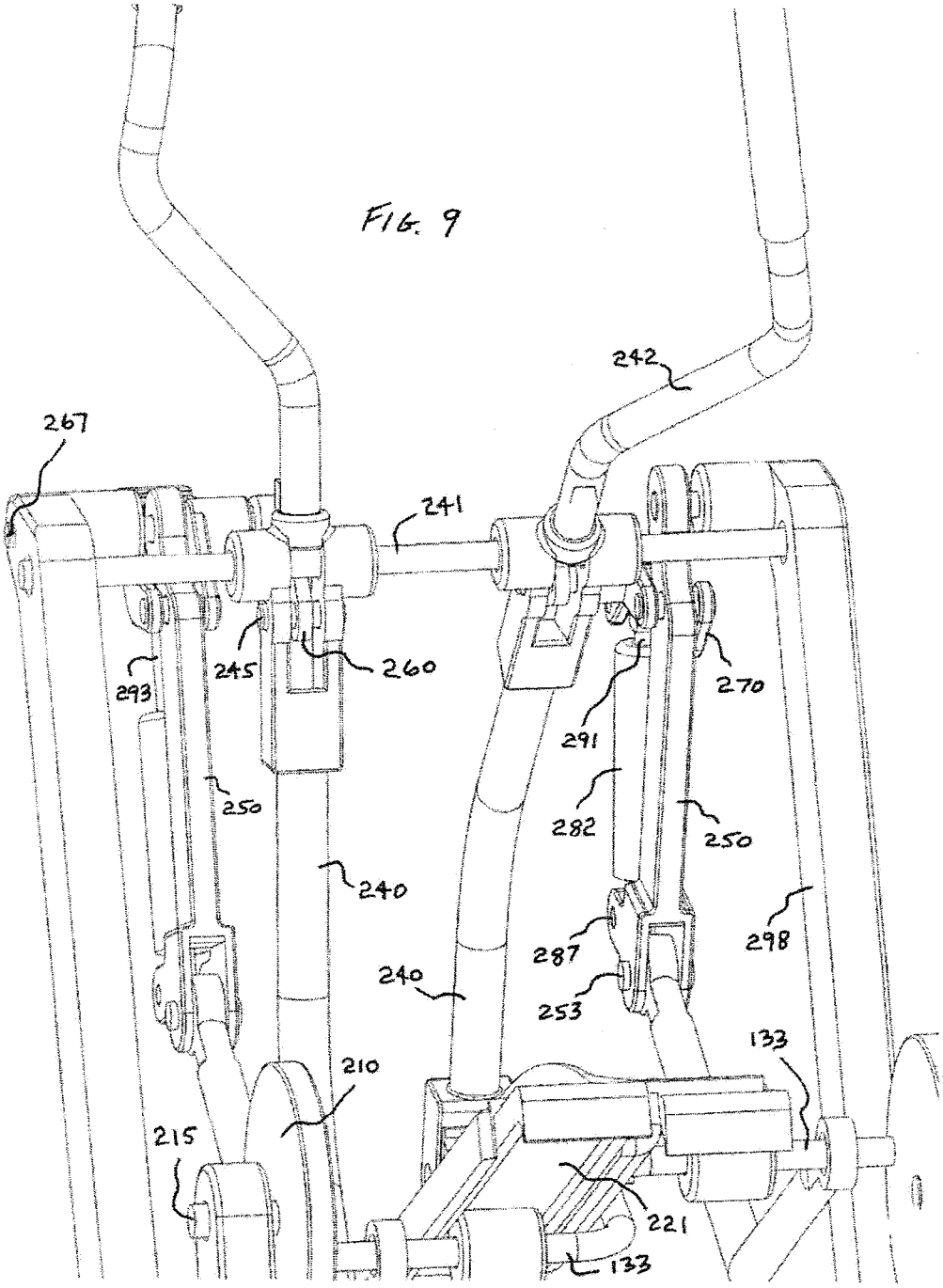
FIG. 9 is an enlarged fragmentary perspective view taken from the rear of the exercise apparatus of FIG. 5.
Figure 10:
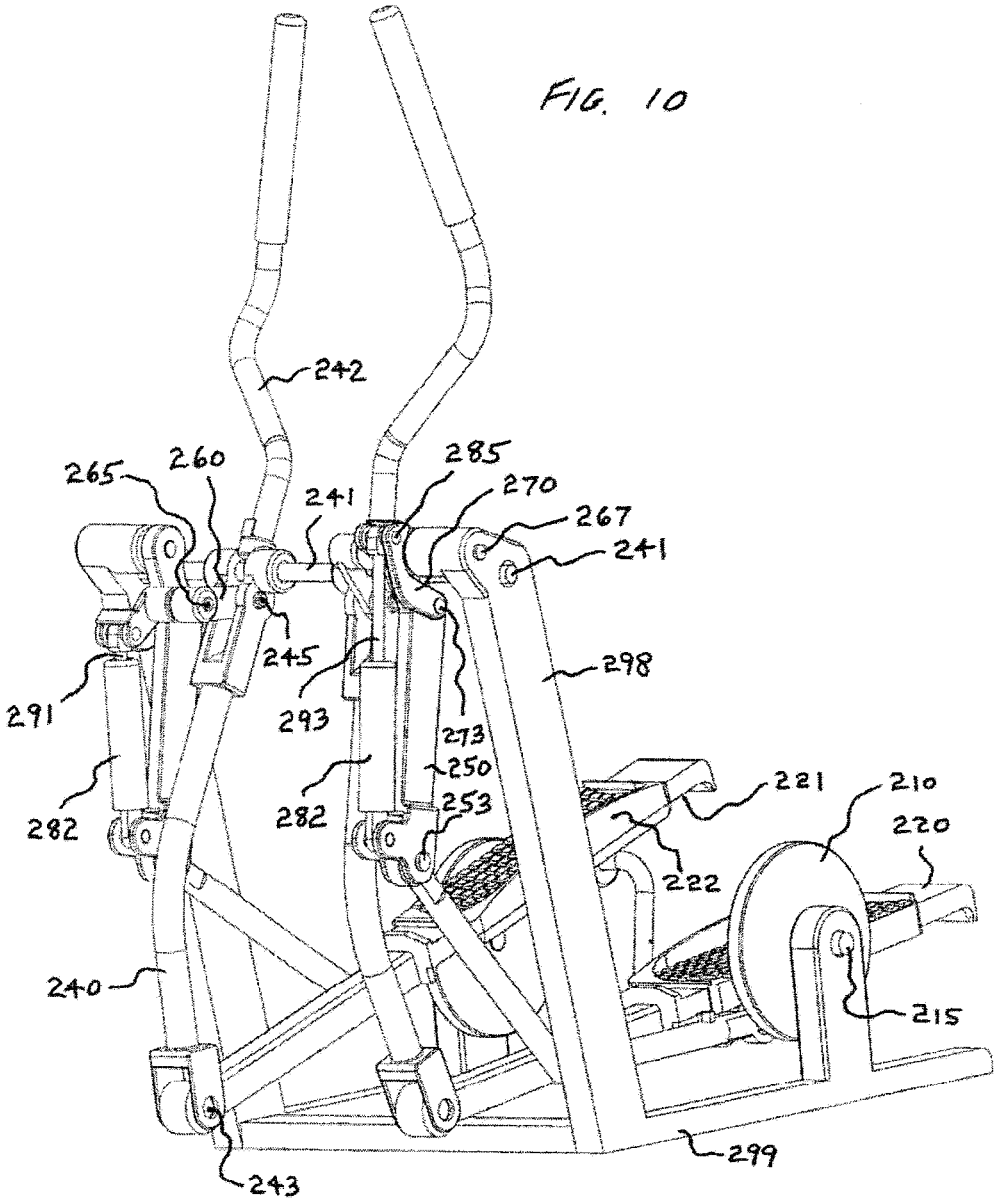
FIG. 10 is a perspective view of the exercise apparatus of FIG. 5.
Figure 11:
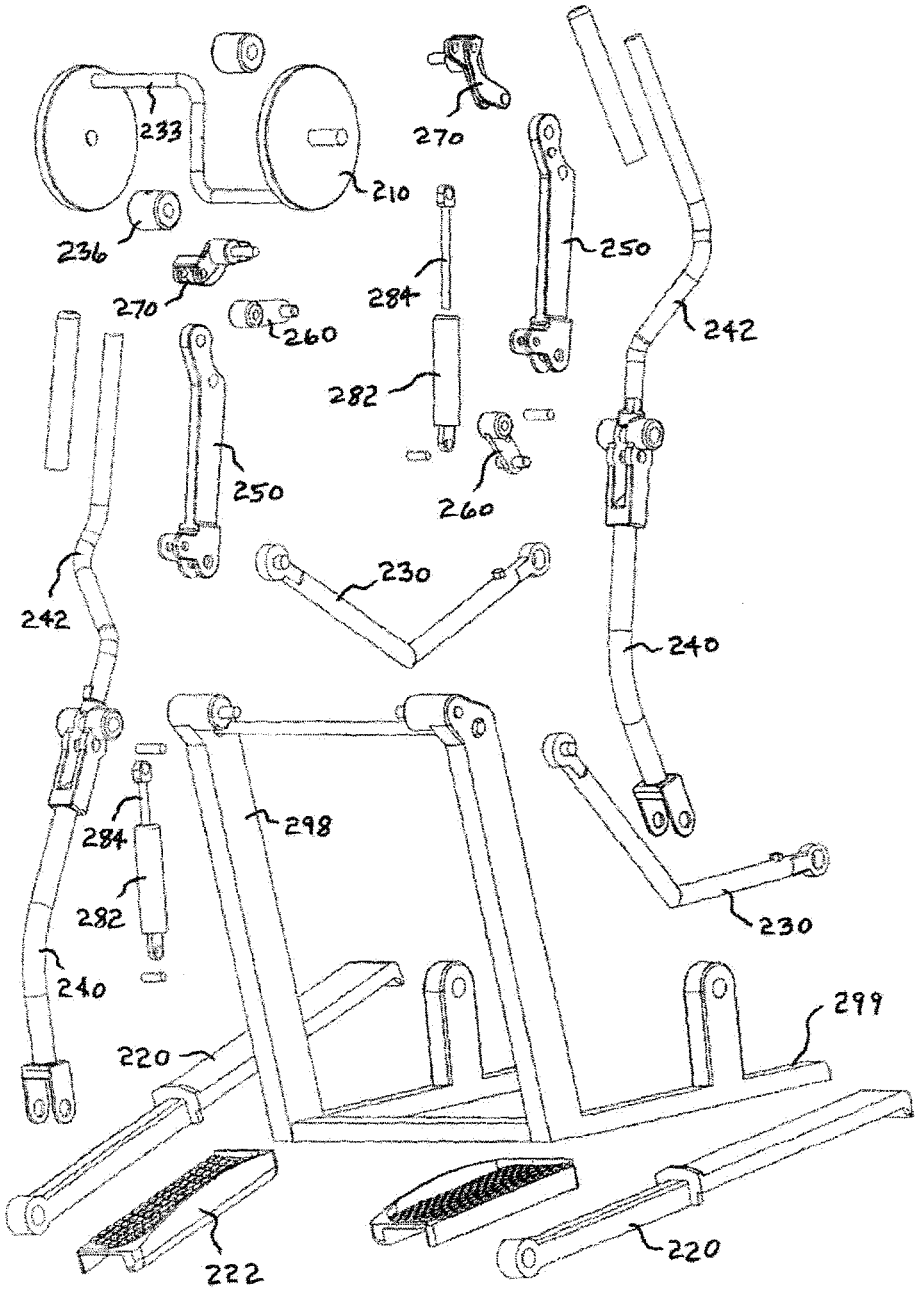
FIG. 11 is an exploded perspective view of the components of the exercise apparatus of FIG. 5.
Figure 12:
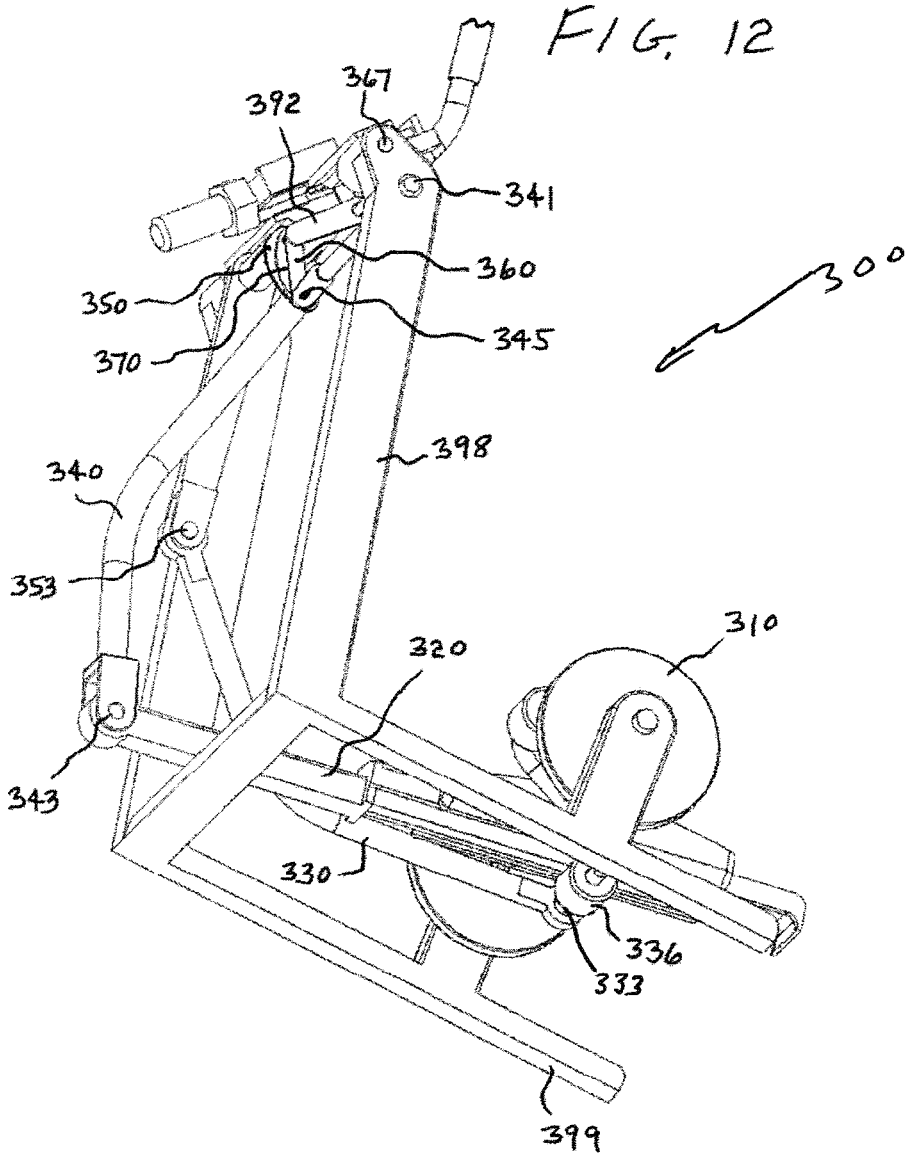
FIG. 12 is a perspective view of a third embodiment of the present invention adjusted for a minimum longitudinal foot path showing the crank oriented at a first crank position.
Figure 13:
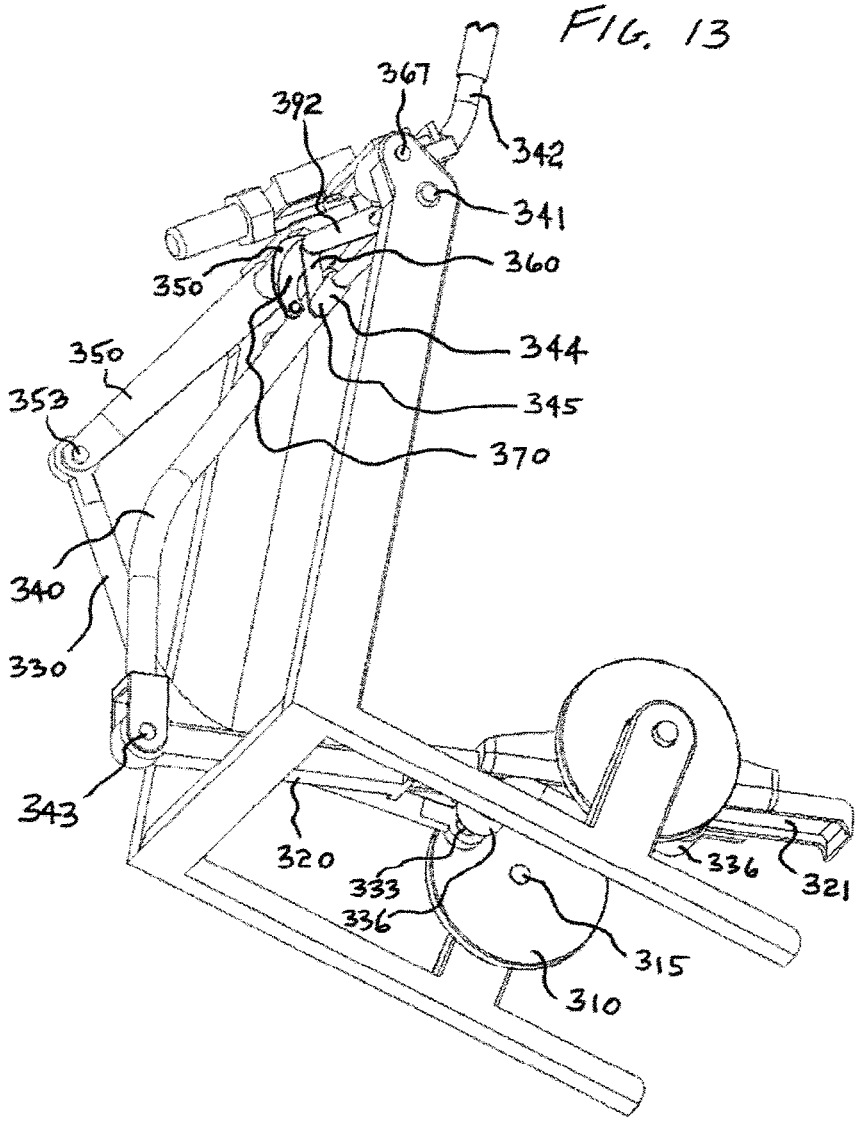
FIG. 13 is a perspective view of the exercise apparatus of FIG. 12 adjusted for a minimum longitudinal foot path showing the crank oriented at a second crank position.
Figure 14:
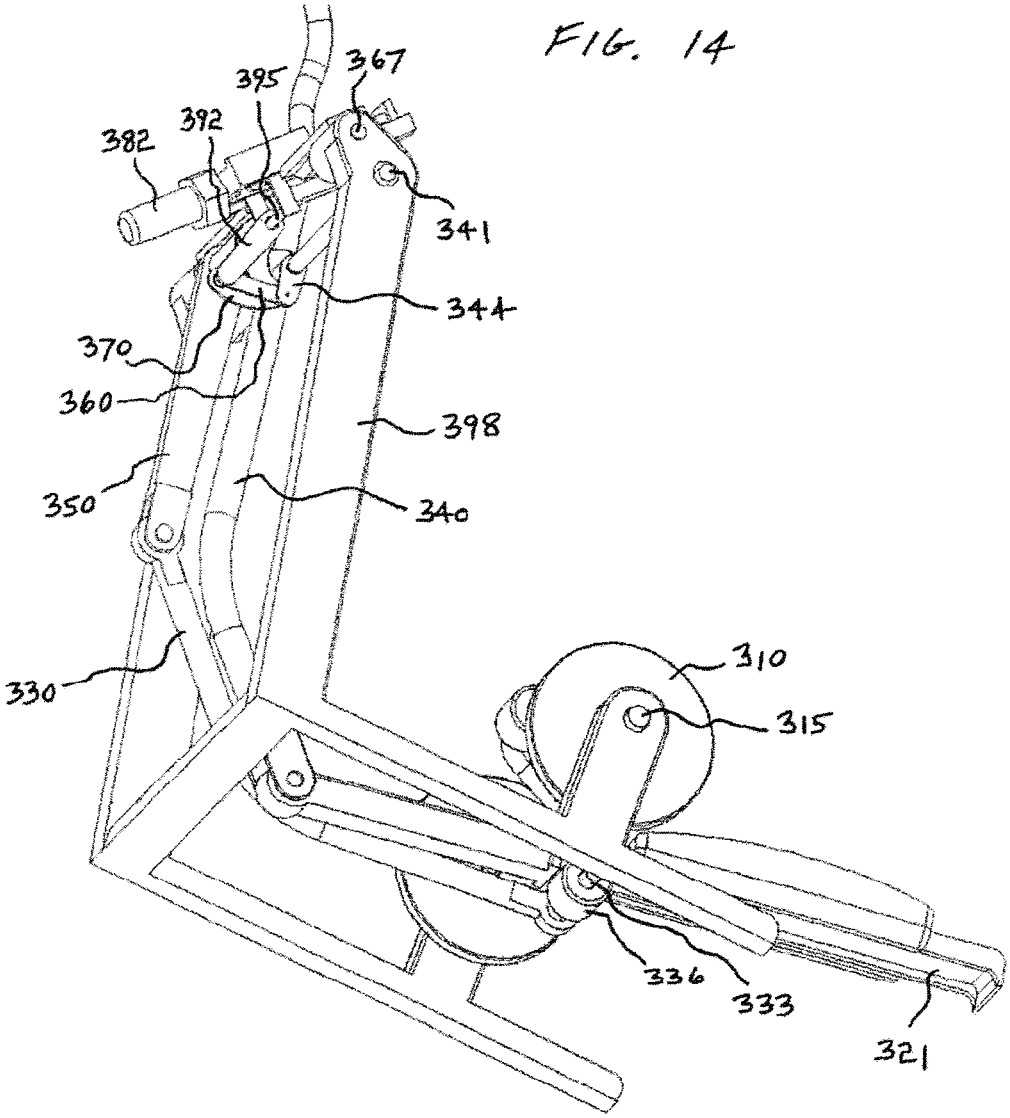
FIG. 14 is a perspective view of the exercise apparatus of FIG. 12 adjusted for a maximum longitudinal foot path showing the crank oriented at a first crank position.
Figure 15:
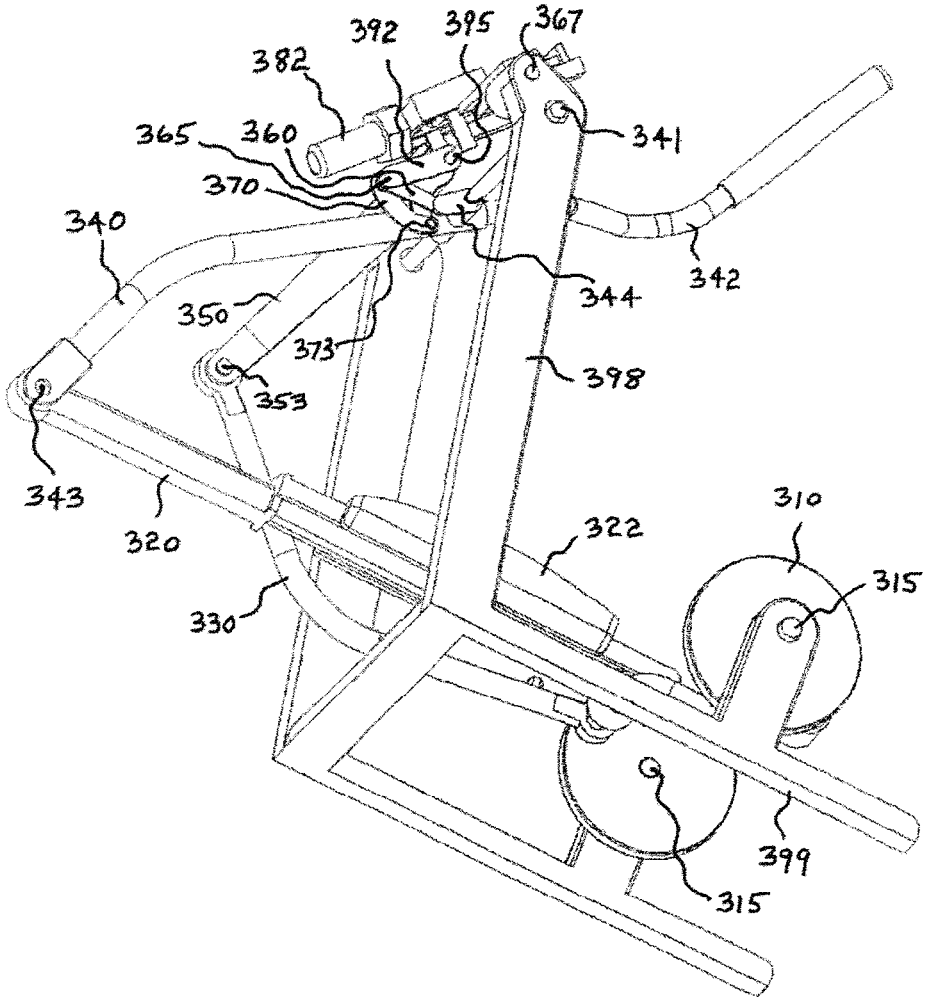
FIG. 15 is a perspective view of the exercise apparatus of FIG. 12 adjusted for a maximum longitudinal foot path showing the crank oriented at a second crank position.
Figure 16:
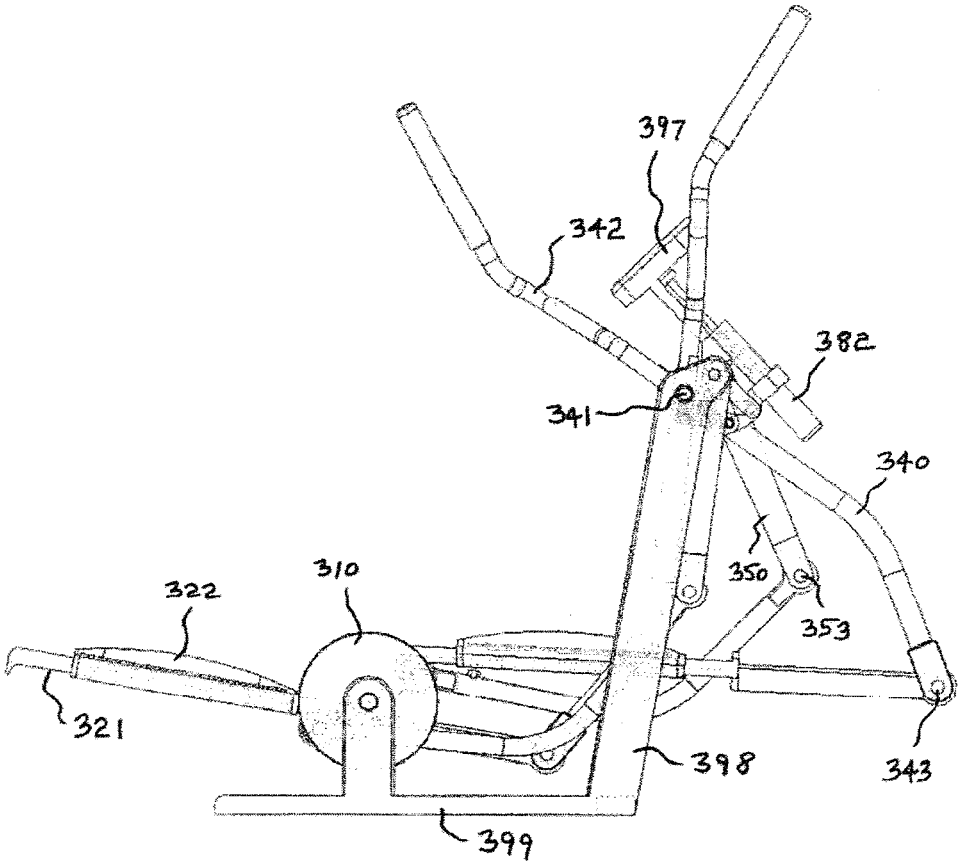
FIG. 16 is a side view of the exercise apparatus of FIG. 12.
Figure 17:
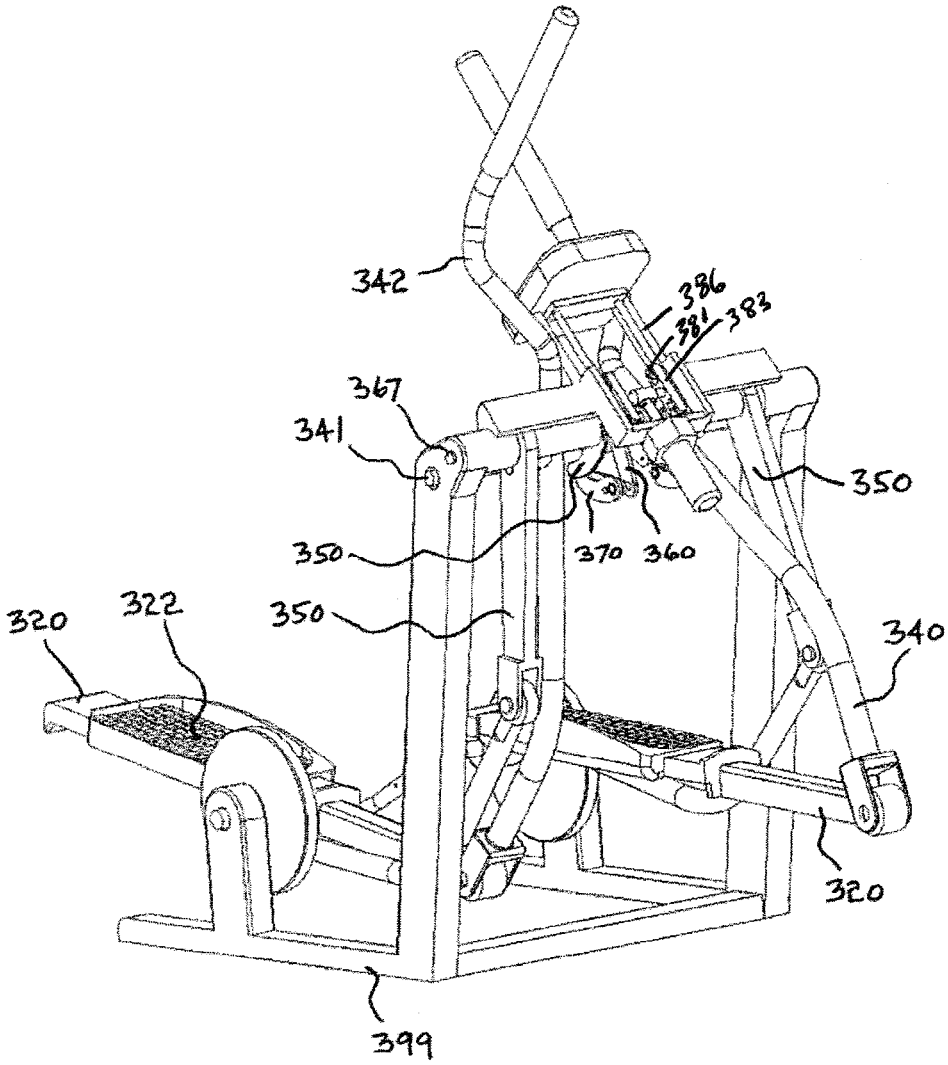
FIG. 17 is a front perspective view of the exercise apparatus of FIG. 12.
Figure 18:
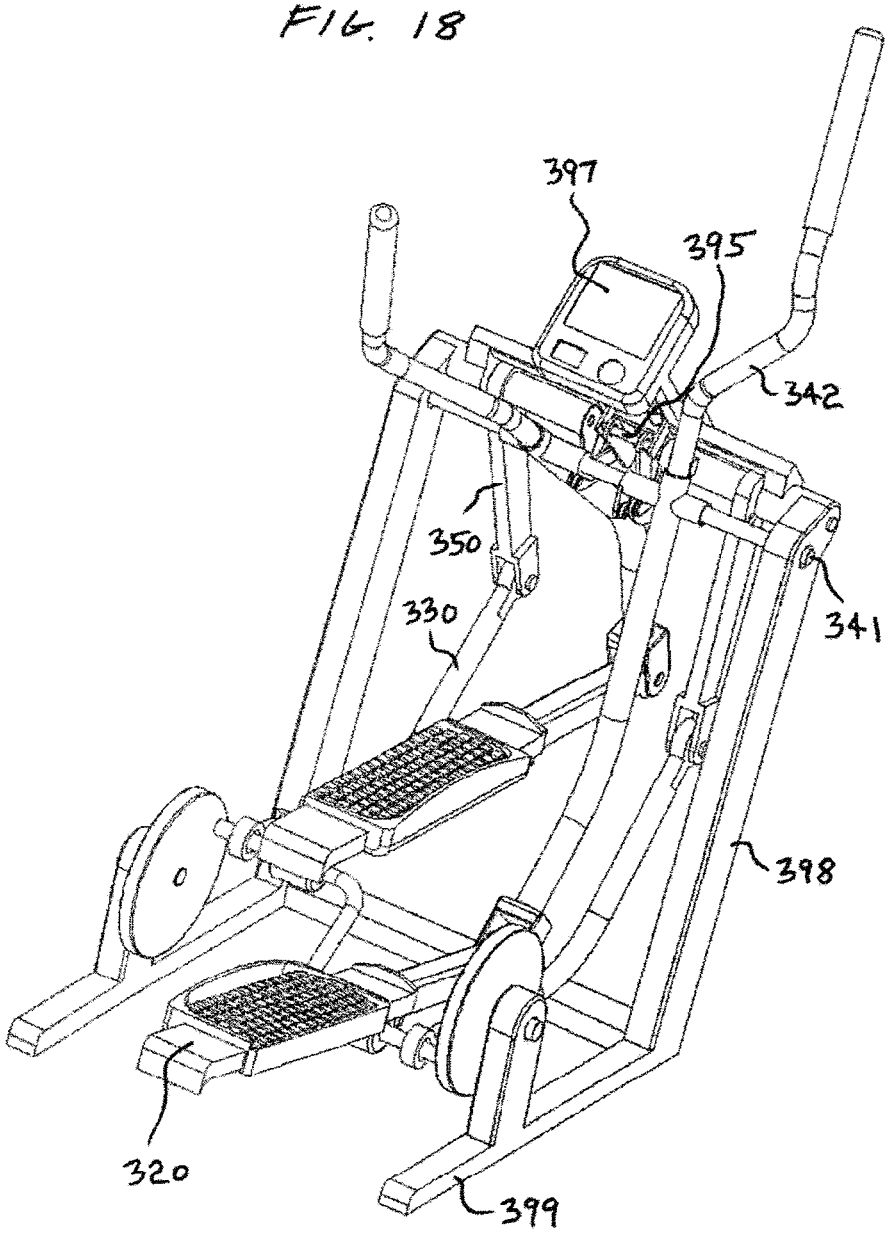
FIG. 18 is a rear perspective view taken from the right side of the exercise apparatus of FIG. 12.
Figure 19:
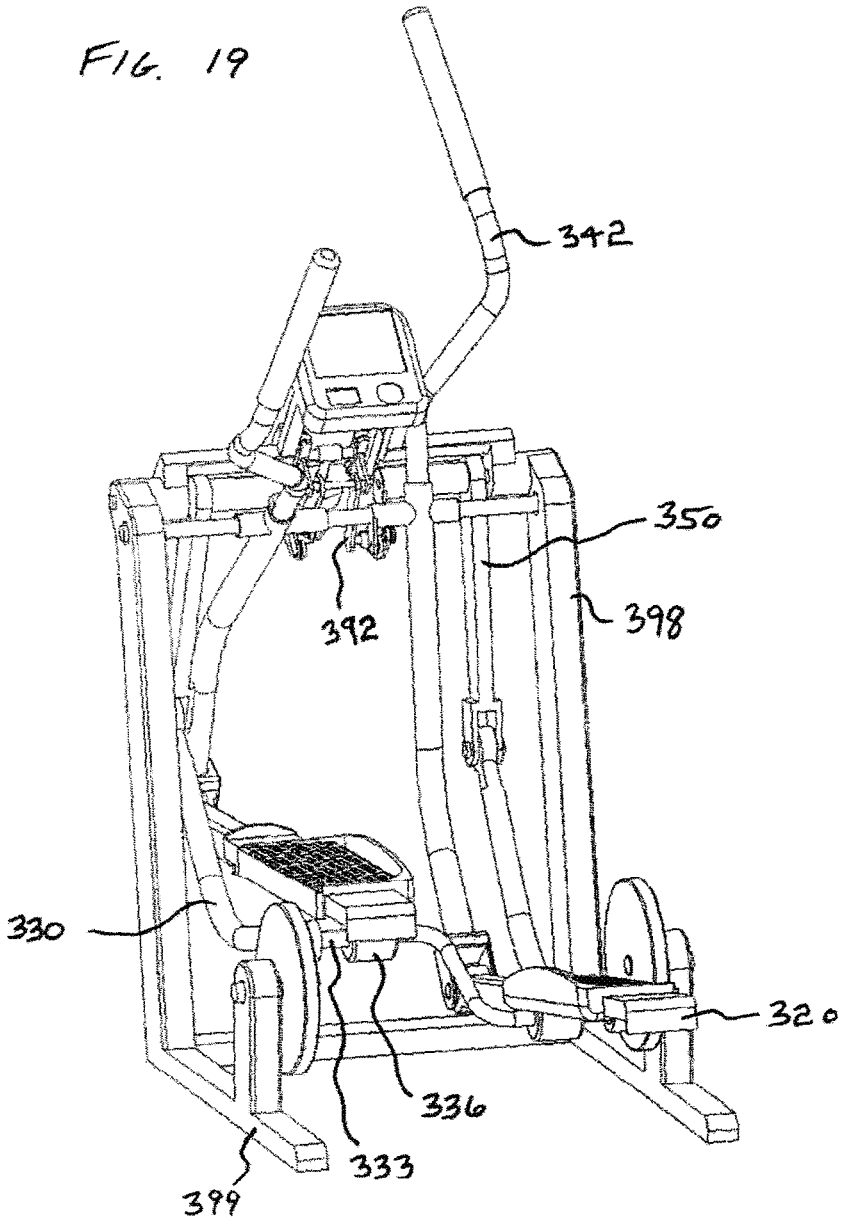
FIG. 19 is a rear perspective view taken from the left side of the exercise apparatus of FIG. 12.
Figure 20:
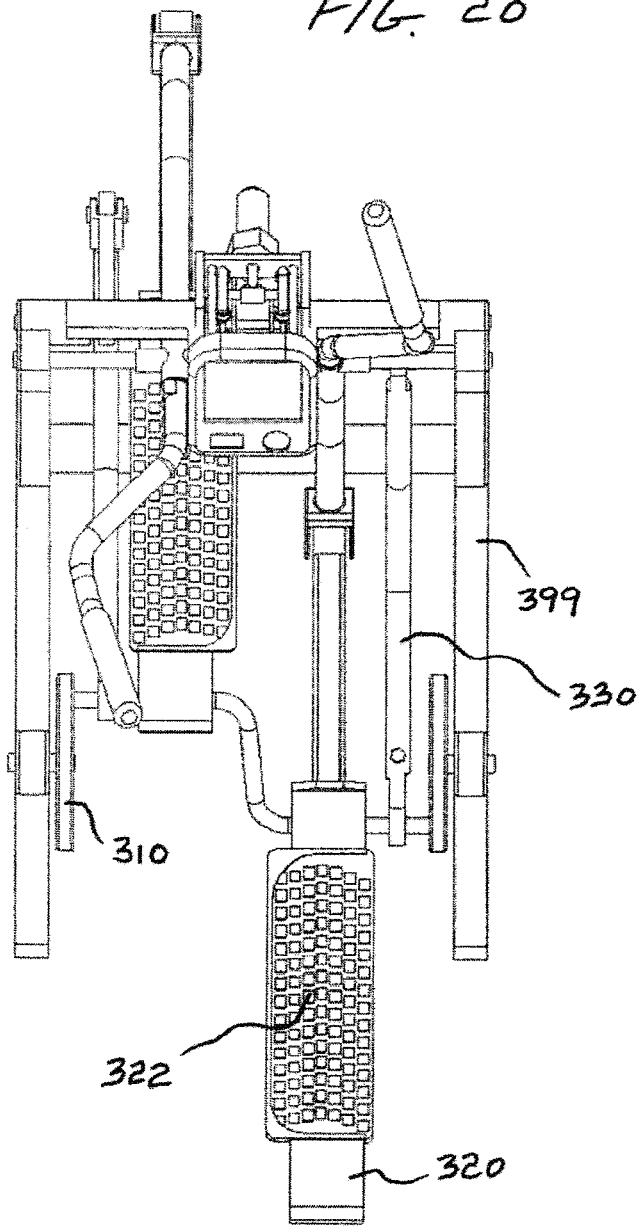
FIG. 20 is a top view of the exercise apparatus of FIG. 12.
Figure 21:
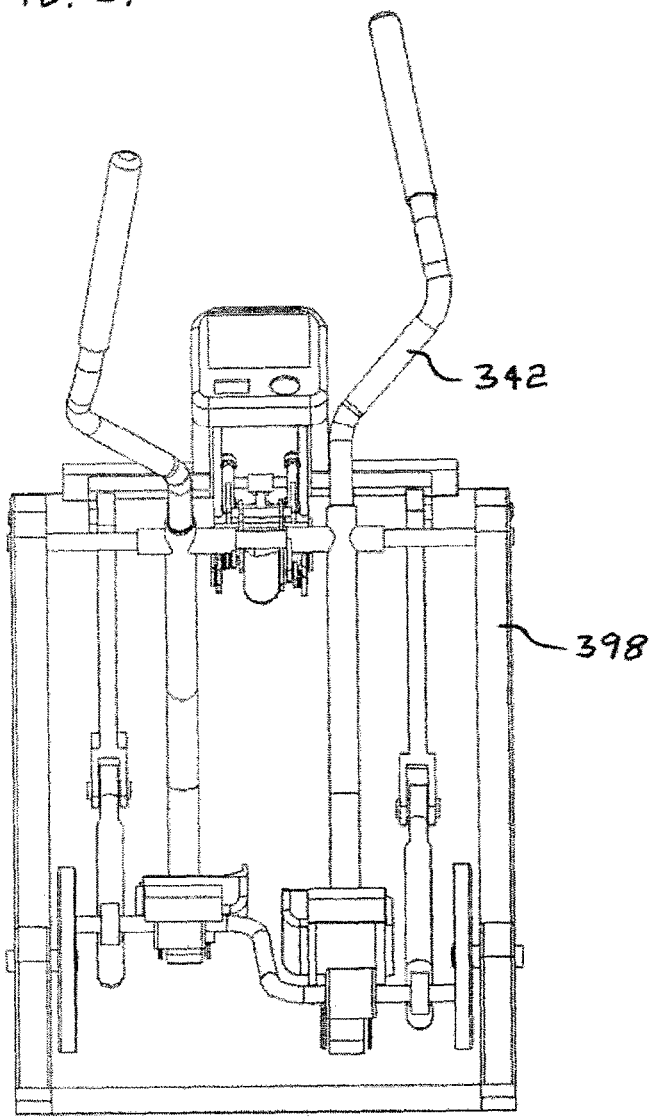
FIG. 21 is a rear end view of the exercise apparatus of FIG. 12.
Figure 22:
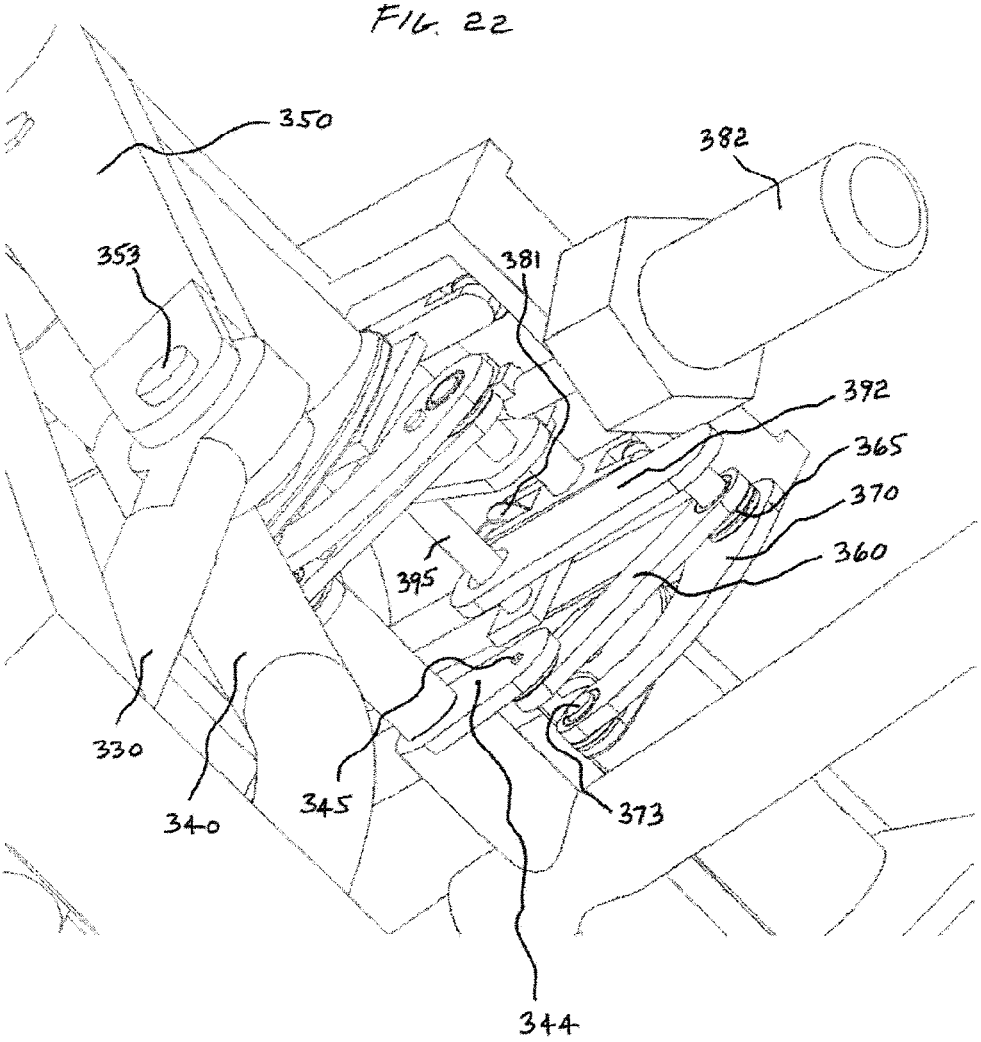
FIG. 22 is an enlarged fragmentary perspective view taken from the front of the exercise apparatus of FIG. 12.
Figure 23:
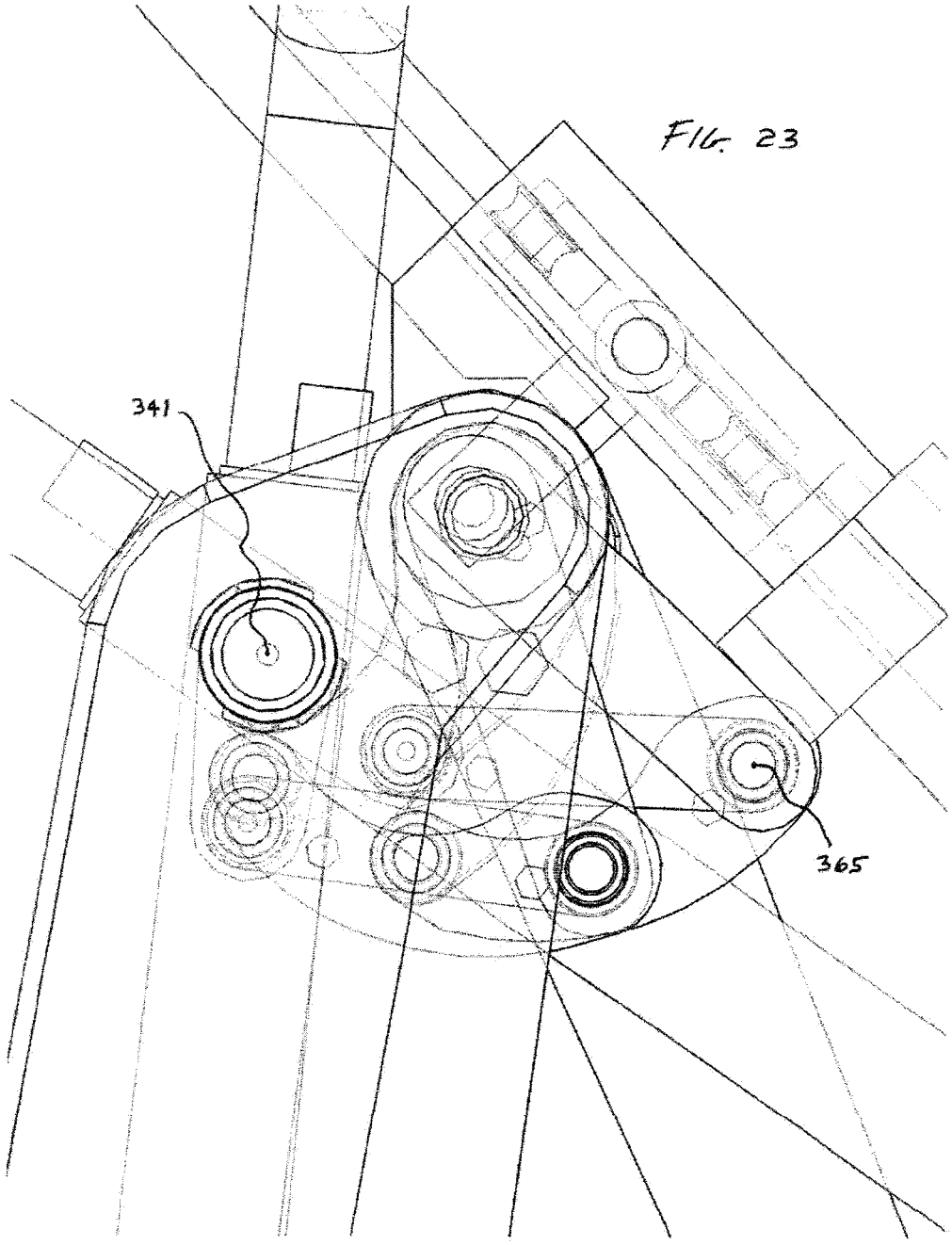
FIG. 23 is an enlarged fragmentary side view of the exercise apparatus of FIG. 12 with hidden lines visible.
Figure 24:
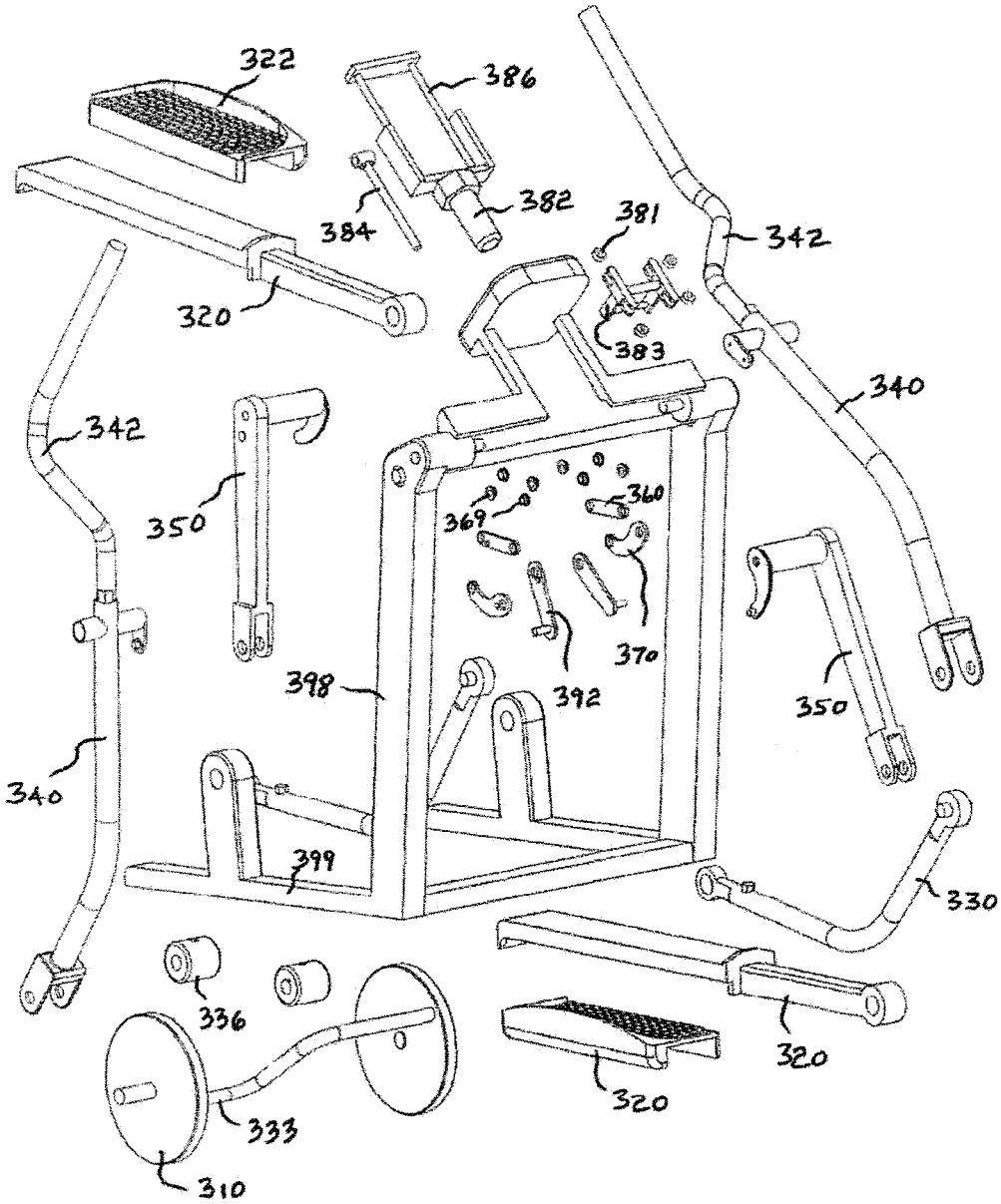
FIG. 24 is an exploded perspective view of the components of the exercise apparatus of FIG. 12.
Figure 25:
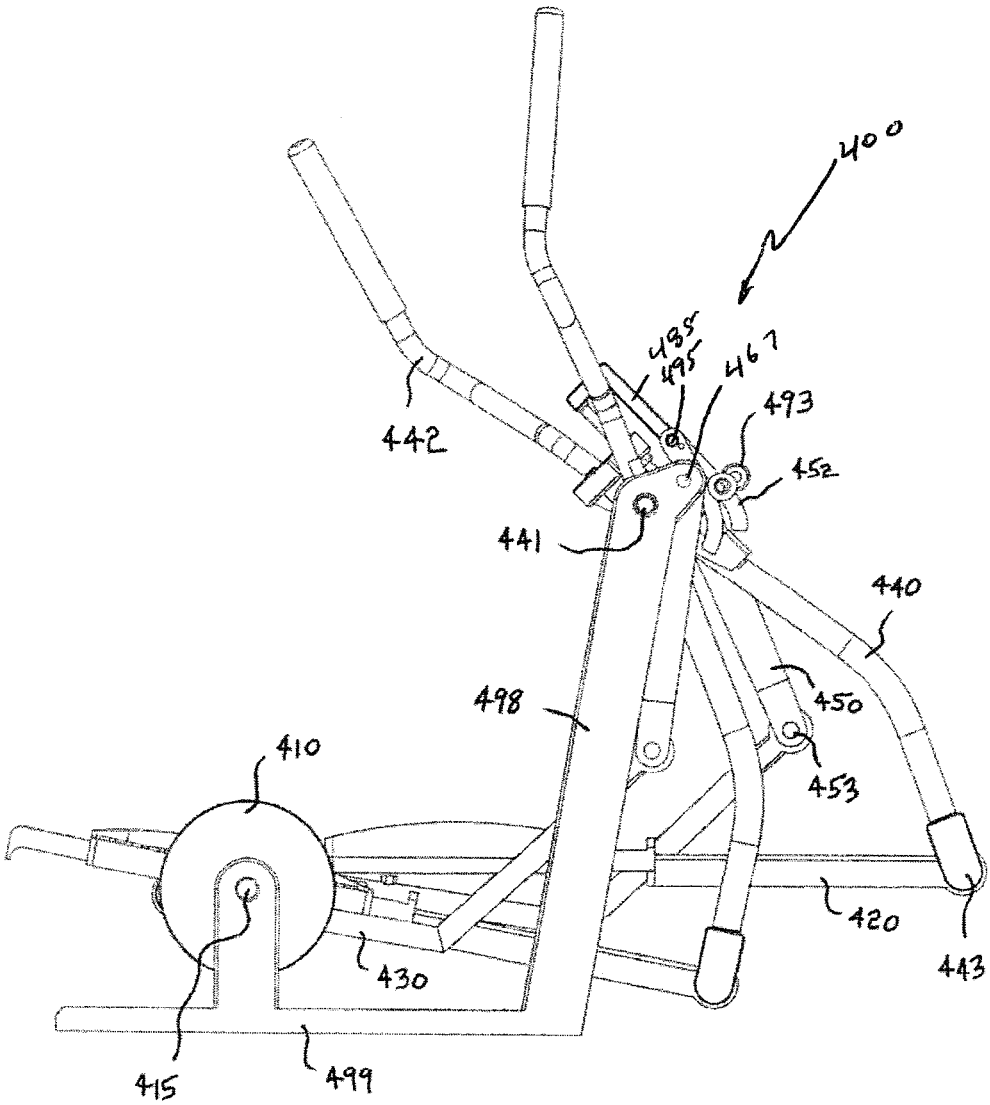
FIG. 25 is a side view of a fourth embodiment of the present invention.
Figure 26:
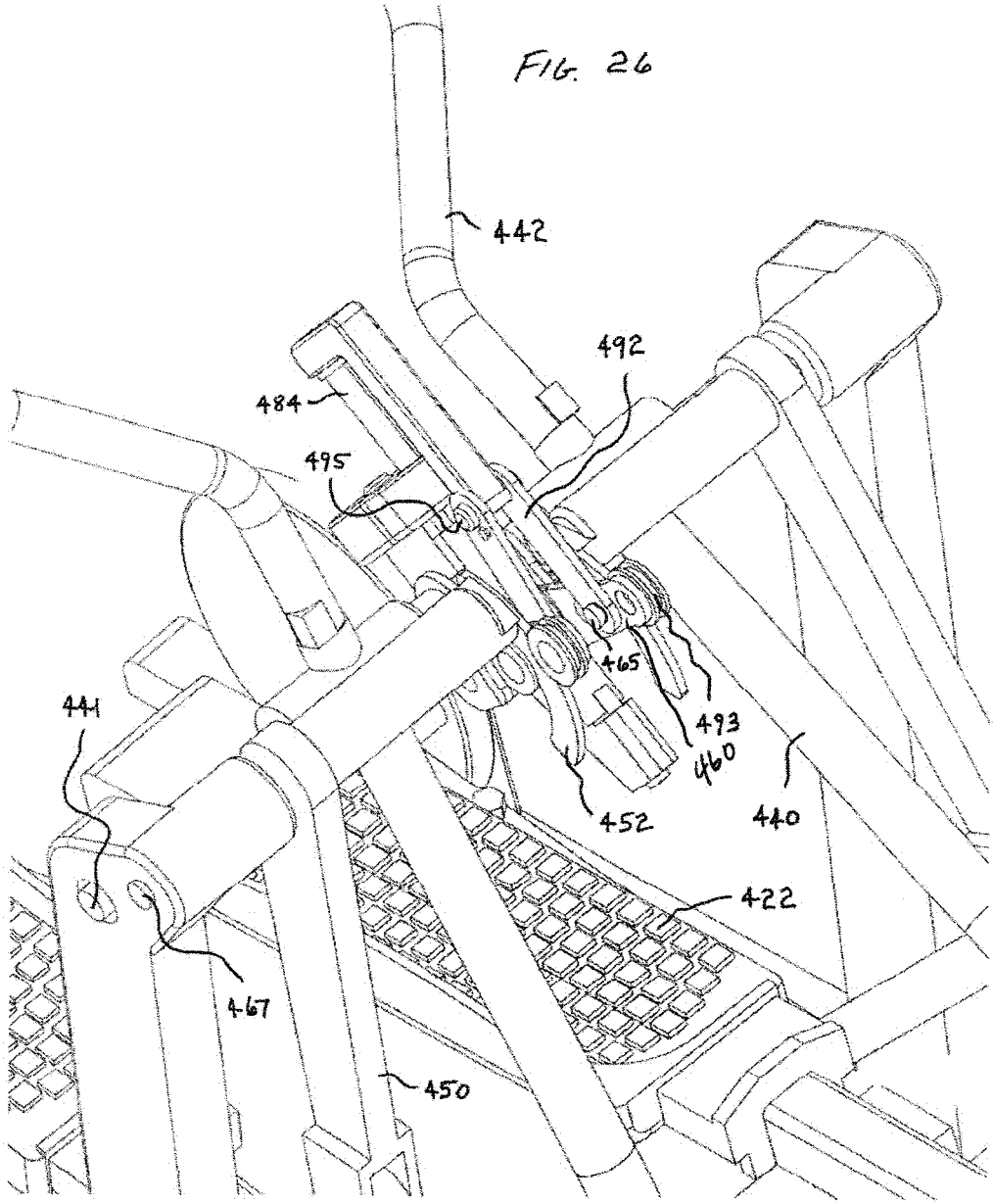
FIG. 26 is an enlarged fragmentary perspective view taken from the front of the exercise apparatus of FIG. 25.

A rearward distal end of a drawbar 230 is rotatably connected to the crank shaft 233, and a forward distal end of the drawbar 230 is rotatably connected to a lower distal end of a drawbar rocker 250 at shaft 253. An upper distal end of the drawbar rocker 250 is rotatably connected to the frame stanchion 298 at shaft 267. A first intermediate link 260, shown in FIG. 6, has a first end rotatably connected to a handle bar rocker 240 at shaft 245. A second intermediate link 270 has a first end rotatably connected to the drawbar rocker 250 at shaft 273. A second end of the first intermediate link 260 is rotatably connected to a second end of the second intermediate link 270 at shaft 265, shown in FIG. 8. In order to provide adjustability of the foot path, a rod end 291 or 293 of an actuator 282 is rotatably connected to the second intermediate link 270 at shaft 285. The base end of the actuator 282 is rotatably connected to the drawbar rocker 250 at shaft 287. In FIG. 8, the rod end 291 is arbitrarily shown retracted into the actuator 282 which would result in a relatively long stride path length, and the rod end 293 is extended away from actuator 282 thereby resulting in a relatively short stride path length. Typically, during operation, the rod ends 291 and 293 would be extended/retracted equally such that both feet of the user travel along similar foot paths. As indicated earlier, the actuator 282 alternatively may be a motor which adjusts the distance between shafts 285 and 287, or may be some form of spring, damper, and/or some combination of spring-damper, or other mechanism which allows the user to in one instance manually adjust the stride length, or have the stride length vary as a function of user applied force. In the former instance, a computer program may effect a change in the stride length as part of an interactive program, or during the course of responding to signals from strain gauges and the like which may be incorporated into the exercise apparatus 200 for purposes of variable and responsive foot path changes. It is further understood that signal(s) may be monitored at other electrical components of the machine, for example, at an electronic brake as an input signal which may cause the foot stride length to be varied.

Directing attention now to FIGS. 12-24, a third embodiment of the present invention generally identified by the reference numeral 300 is shown. It will be observed that FIGS. 12-15 show only one side of the exercise apparatus 300 for clarity of illustration. A frame 399 rotatably supports a crank disk 310 at crank axle 315. A handle bar rocker 340 is rotatably connected to a front stanchion 398 of the frame 399 at shaft 341. A handle bar 342 is rigidly connected to the handle bar rocker 340. A lower distal end of the handle bar rocker 340 is rotatably connected to a forward distal end of longitudinal foot member 320 at shaft 343. A foot platform 322 is rigidly connected to the foot member 320. A crank roller 336 is rotatably secured to a crank shaft 333, and supports the foot member 320. The crank roller 336 is generally in rolling contact with a race 321 of the foot member race 320.

A rearward distal end of a drawbar 330 is rotatably connected to the crank shaft 333, and a forward distal end of the drawbar 330 is rotatably connected to a lower distal end of a drawbar rocker 350 at shaft 353. An upper distal end of the drawbar rocker 350 is rotatably connected to the stanchion 398 at shaft 367. A first intermediate link 360 has a first end rotatably connected to the handle bar rocker 340 at shaft 345. A lobe 344 rigidly connected with the handle bar rocker 340 (and handle bar 342) is provided for spatial purposes as will be evident in other illustrations shown and described herein. Continuing now, a second intermediate link 370 (more clearly shown in FIG. 22) has a first end rotatably connected to the drawbar rocker 350 at shaft 373. A second end of the first intermediate link 360 is rotatably connected to a second end of the second intermediate link 370 at shaft 365. In order to provide adjustability of the foot path, a rod end 384 of the actuator 382 is connected to carriage 383. Carriage 383 is constrained to travel parallel to rails 386, as rollers 381 engage and roll therewith. A control link 392 is rotatably connected to the carriage 383 at shaft 395. The control link 392 moves shaft 365 relatively closer or further away from shaft 367 (more clearly shown in FIG. 15) while adjusting the foot path. As indicated earlier herein, the actuator 382 may be a motor which adjusts the relative position of shaft 365, or alternatively may be some type of spring, damper, and/or some combination of spring-damper, or other mechanism which allows the user to in one instance manually adjust the stride length, or have the stride length vary as a function of user applied force. In the former instance, a computer program may effect a change in the stride length as part of an interactive program, or during the course of responding to signals from strain gauges and the like which may be incorporated into the machine for purposes of variable and responsive foot path changes. It is understood that the signal(s) may be monitored at other electrical components of the machine, for example, at an electronic brake as an input signal which may cause the foot stride length to be varied.

Referring now to FIGS. 25-30, a fourth embodiment of the present invention generally identified by the reference numeral 400 is shown. A frame 499 rotatably supports a crank disk 410 at a crank axle 415. A handle bar rocker 440 is rotatably connected to a front stanchion 498 of the frame 499 at shaft 441. A handle bar 442 is rigidly connected to the handle bar rocker 440. A handle bar lobe 444, rigidly connected to the handle bar 440, is provided for spatial purposes as will be evident in other illustrations shown and described herein. A lower distal end of the handle bar rocker 440 is rotatably connected to a forward distal end of a longitudinal foot member 420 at shaft 443. A foot platform 422 is rigidly connected to the foot member 420. A crank roller 436 is rotatably secured to a crank shaft 433, and supports the foot member 420. The crank roller 436 is generally in rolling contact with a race 421 of the foot member 420.

A rearward distal end of a drawbar 430 is rotatably connected to the crank shaft 433, and a forward distal end of the drawbar 430 is rotatably connected to a lower distal end of a drawbar rocker 450 at shaft 453. An upper distal end of the drawbar rocker 450 is rotatably connected to a stanchion 498 of the frame 499 at shaft 467. A drawbar rocker race 452 is rigidly connected to the upper distal end of the drawbar rocker 450. A yoke pivot member 460 is rotatably connected to the handle bar lobe 444 at shaft 445. A first end of a control link 492 is rotatably connected to the yoke pivot member 460 at shaft 465 and a second end of the control link 492 is rotatably connected to the distal end of an arm 385 485 of an actuator rod extension member 483 at shaft 495. Rollers 493 carried by the yoke pivot member 460 capture and roll along the drawbar rocker race 452, and may be adjusted by a change in the actuator 482 status or length. In order to sufficiently capture the drawbar rocker race 452, the rollers 493 are rotatably secured to the yoke pivot member 460 in a manner that does not permit noticeable clearance or 'play' between the rollers 493 and the drawbar rocker race 452 in order that the foot path be adequately constrained. The actuator 482 is rigidly secured to the frame 499 of the apparatus 400 at the shaft 441, and an actuator rod 484 extends or retracts relative to the actuator 482. The actuator rod 484 includes an L-shaped extension member 483 connected to the distal end thereof. The arm 485 of the extension member 483 is spaced from the actuator rod 484 and extends parallel thereto generally toward the actuator 482. As noted above, the distal end of the arm 485 is rotatably connected to a second end of the control link 492. As indicated earlier, the term actuator may be considered simply a generic term which includes springs, dampers, motors, screws, or any combination thereof. Furthermore, the foot path stride length may be a function of user applied force, manual adjustment, or some combination which may or may not include computer control.

Figure 27:
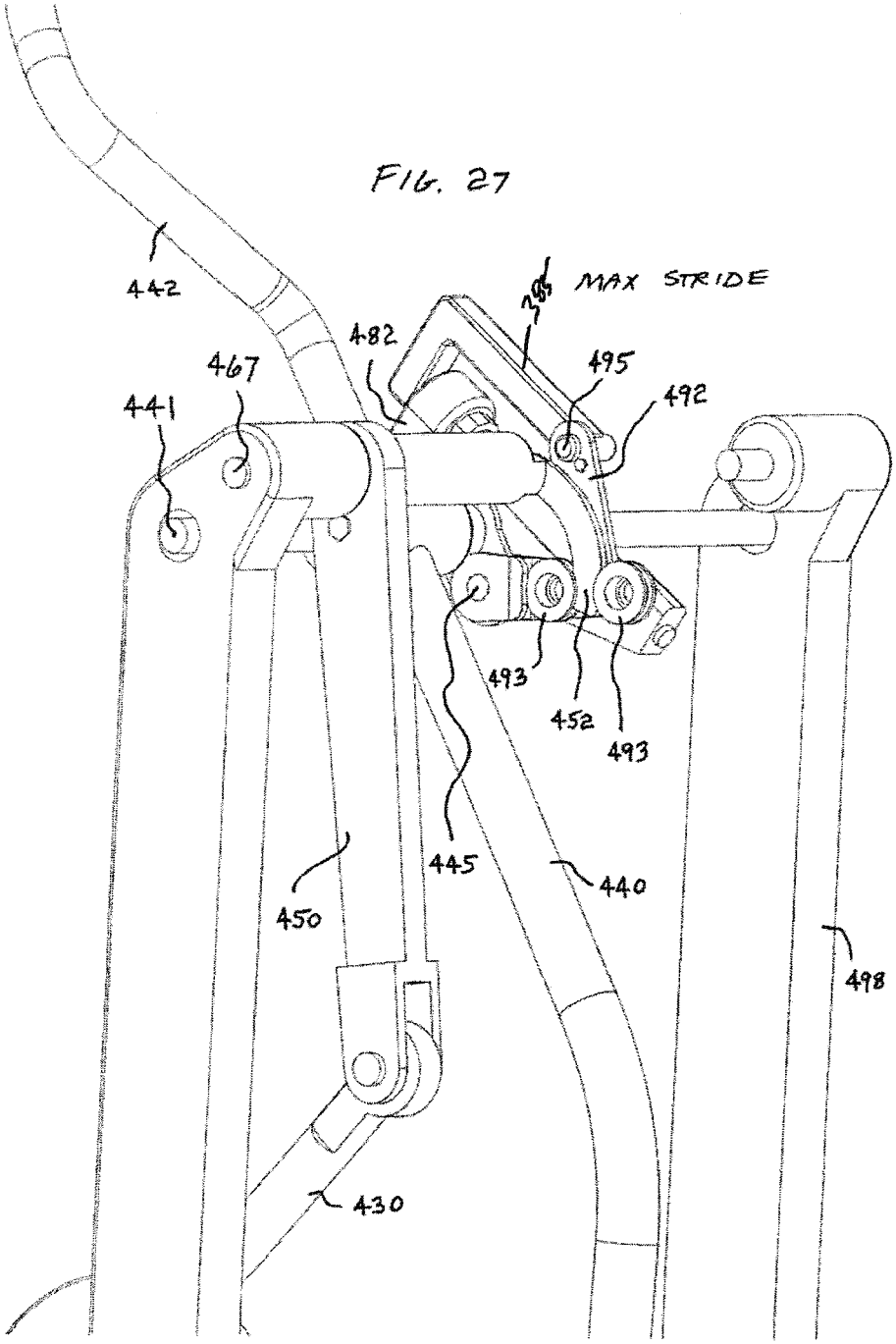
FIG. 27 is an enlarged fragmentary perspective view taken from the front of the exercise apparatus of FIG. 25 adjusted to a maximum stride path.
Figure 28:
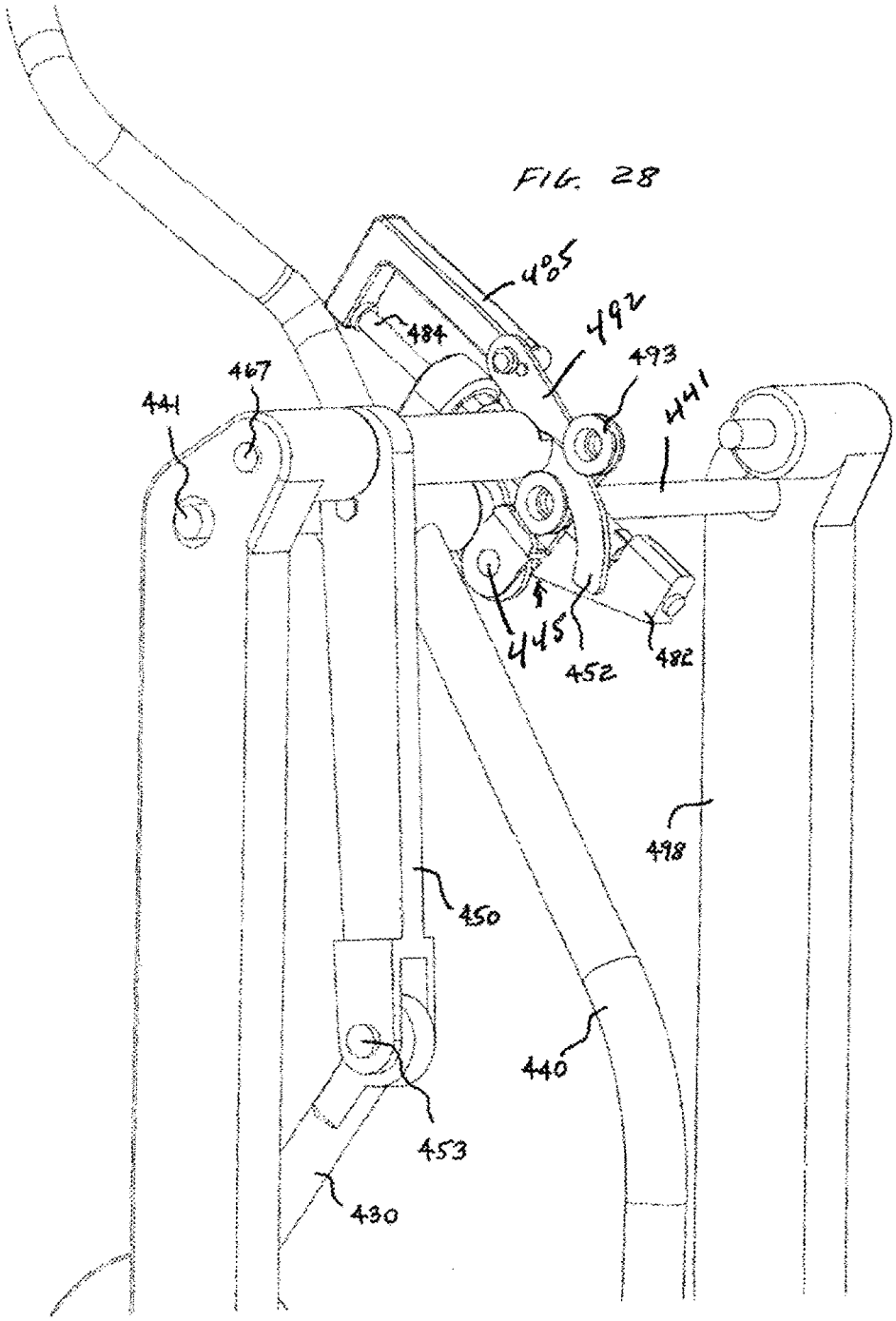
FIG. 28 is an enlarged fragmentary perspective view taken from the front of the exercise apparatus of FIG. 25 adjusted to medium stride path.
Figure 29:
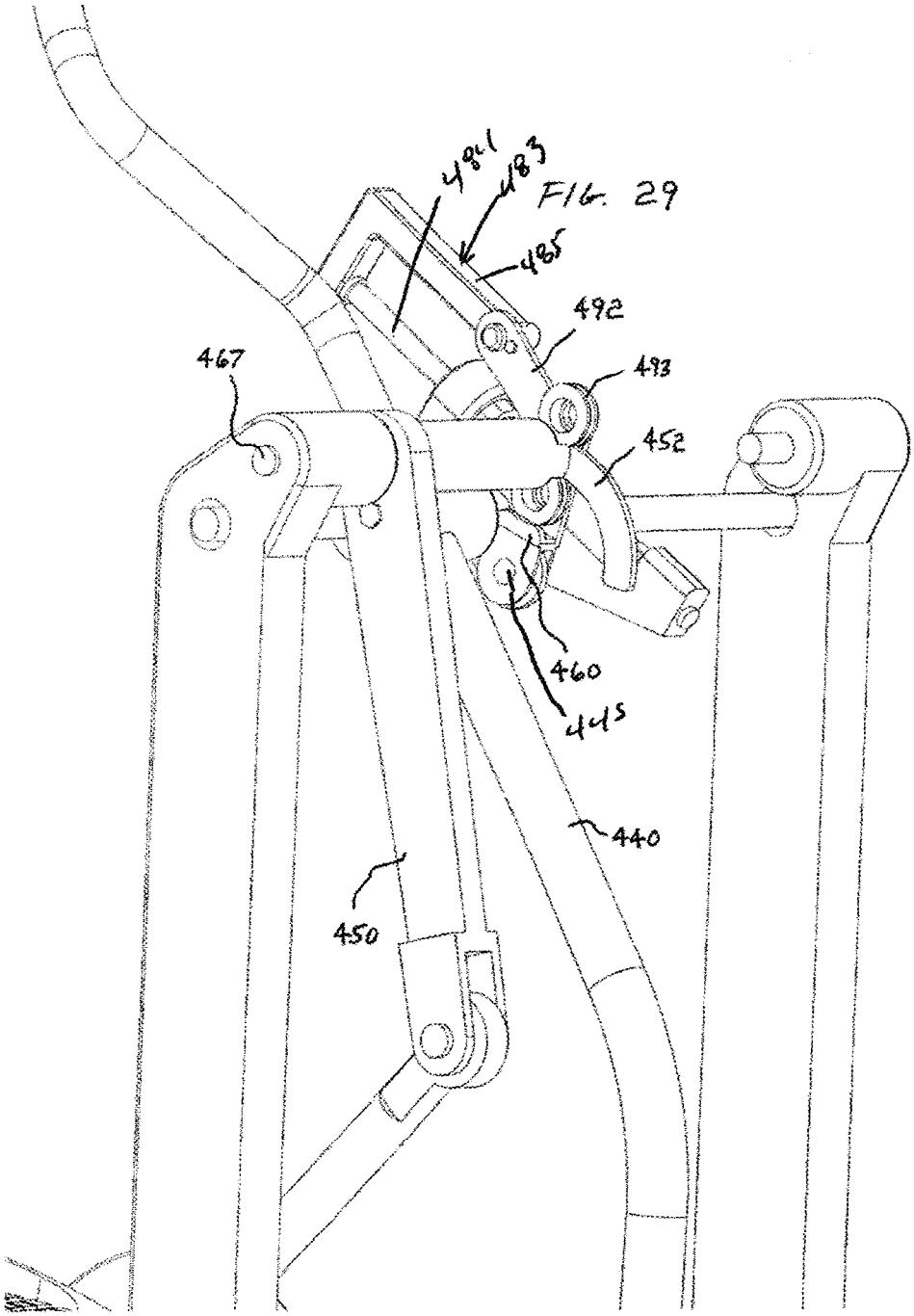
FIG. 29 is an enlarged fragmentary perspective view taken from the front of the exercise apparatus of FIG. 25 adjusted to a minimum stride path.
Figure 30:
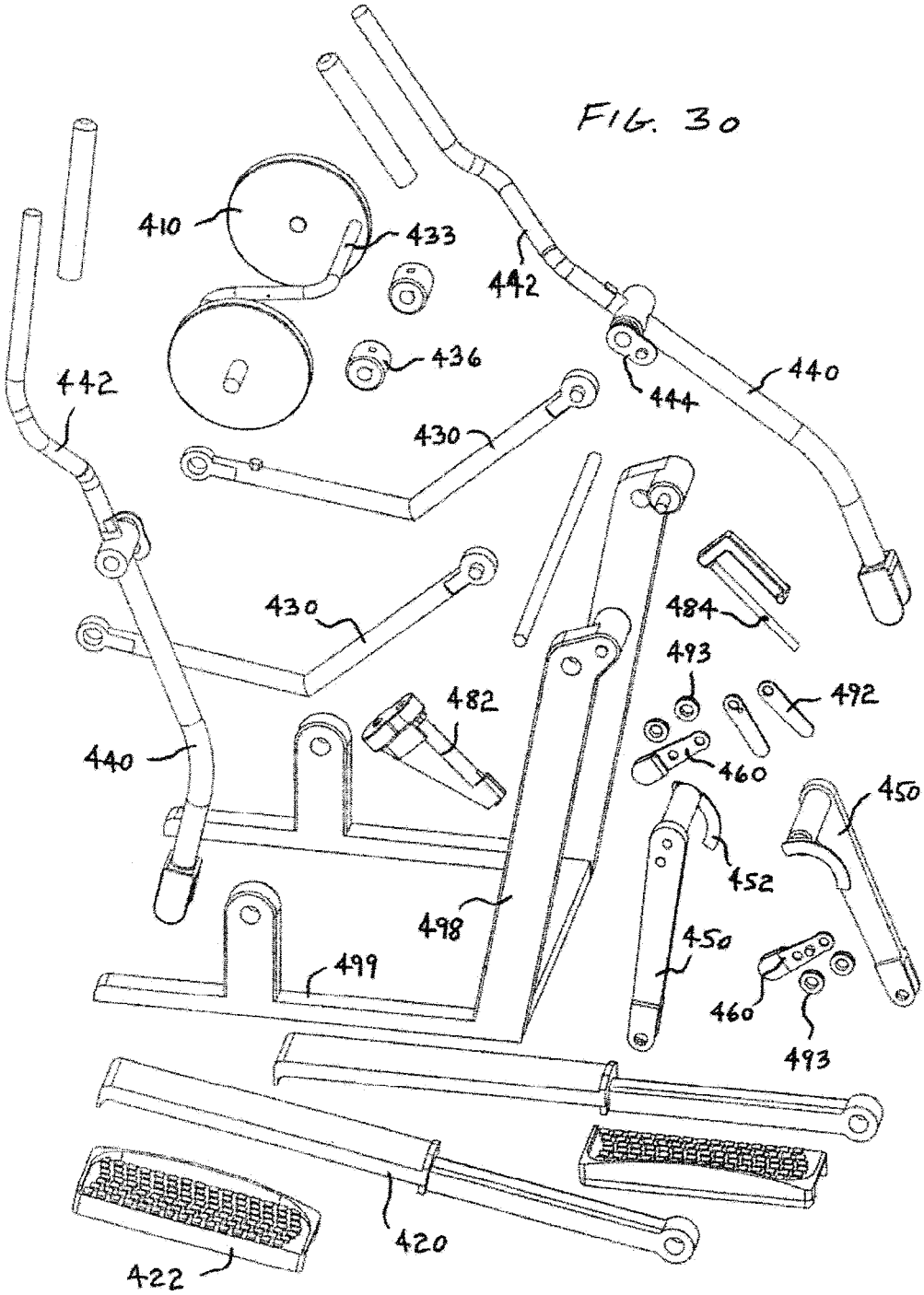
FIG. 30 is an exploded perspective view of the components of the exercise apparatus of FIG. 25.

Referring to FIGS. 27-29, collectively, the actuator rod 484 shown in FIG. 27 is fully retracted into the actuator 482 thereby causing the control link 492 move the yoke pivot member 460 so that the rollers 493 engage the race 452 at a generally greater distance from the axis defined at shaft 467 thereby resulting in a maximum foot path stride length. With regard to FIG. 28, the actuator rod 484 is partially extended and thereby causing the rollers 493 to engage the race 452 at a generally medium distance from the axis defined at shaft 467, consequently resulting in a medium foot path stride length. With regard to FIG. 29, the actuator rod 484 is shown fully extended and thereby causing the rollers 493 to engage the race 452 at a generally minimal distance from the axis defined at shaft 467, consequently resulting in a minimal foot path stride length.

Figure 31:
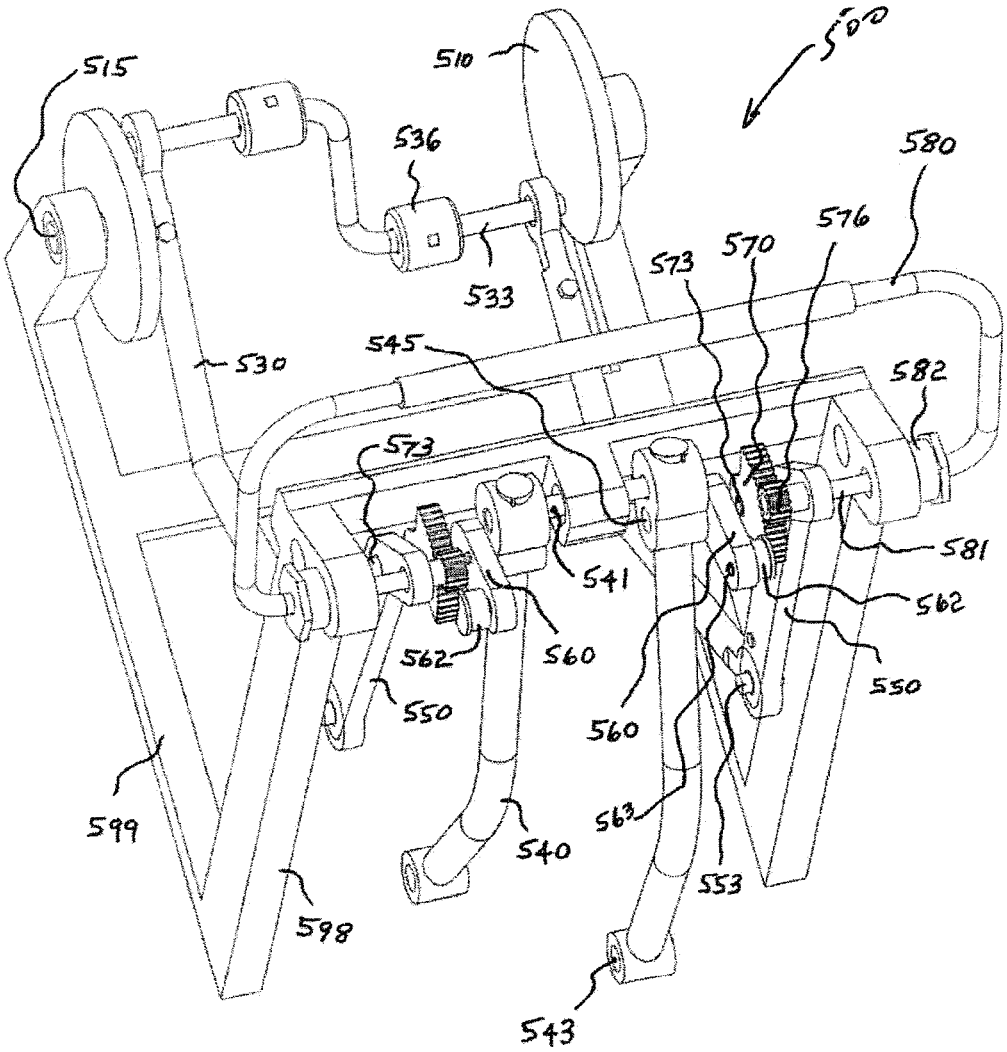
FIG. 31 is a partial perspective view of a fifth embodiment of the present invention.
Figure 32:
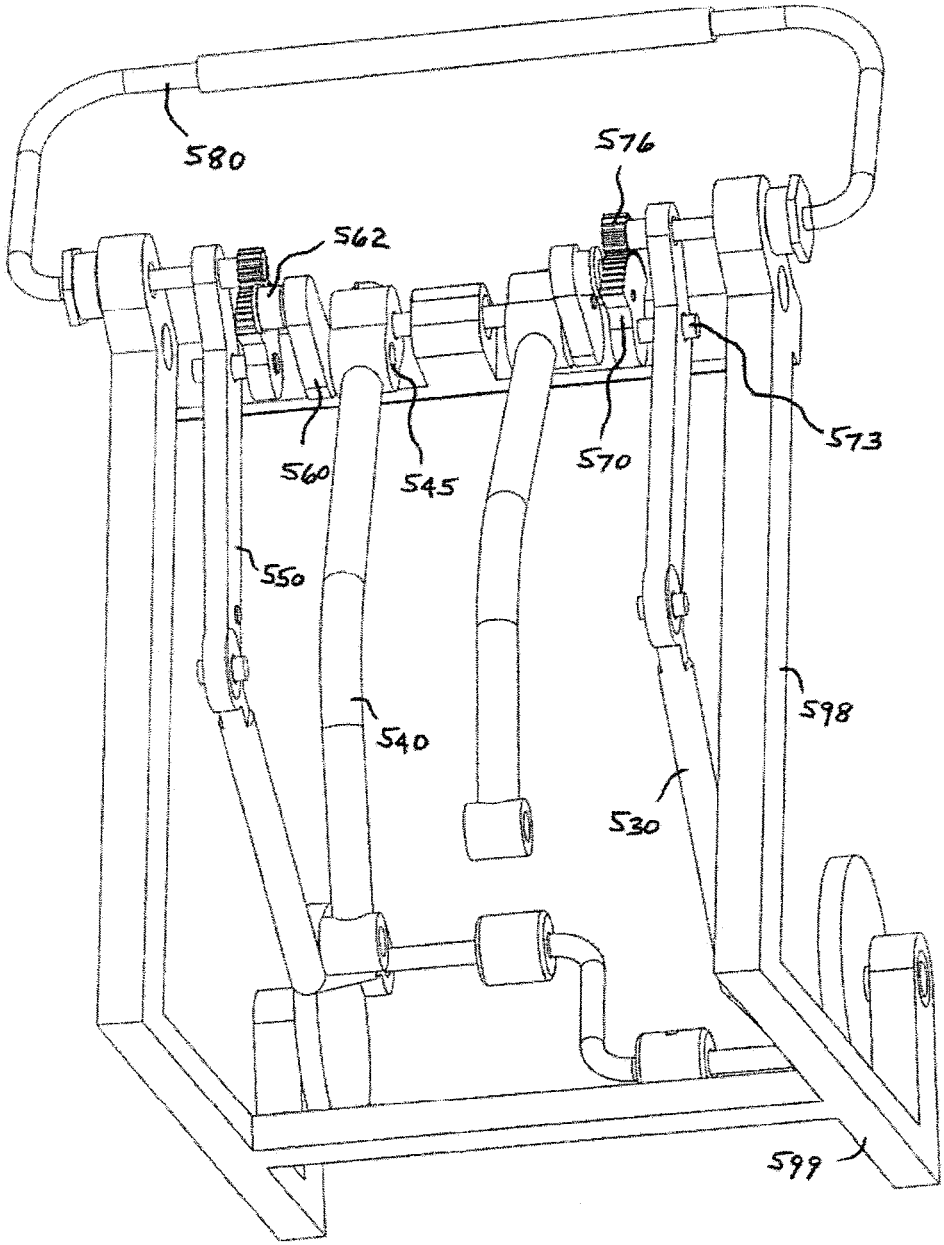
FIG. 32 is a partial perspective view taken from the front and below the exercise apparatus of FIG. 31.

Directing attention now to FIG. 31, a fifth embodiment of the present invention generally identified by reference numeral 500 is shown. The exercise apparatus 500 includes a frame 599 rotatably supporting a crank disk 510 at crank axle 515. A handle bar rocker 540 is rotatably connected to a front stanchion 598 of the frame 599 at shaft 541. A lower distal end of a handle bar rocker 540 is rotatably connected to a forward distal end of a longitudinal foot member (not shown in the drawings) at shaft 543 A crank roller 536 is rotatably secured to a crank shaft 533. The crank roller 536 supports the longitudinal foot member in the same manner previously described herein with regard to the previous embodiments of the present invention.

A rearward distal end of a drawbar 530 is rotatably connected to the crank shaft 533, and a forward distal end of the drawbar 530 is rotatably connected to a lower distal end of a drawbar rocker 550 at shaft 553. An upper distal end of the drawbar rocker 550 is rotatably connected to the stanchion 598 at shaft 581. A transverse hand grip 580 is rigidly secured to the shaft 581 for purposes of adjusting the stride length of the exercise apparatus 500, and as will be described below.

Continuing with FIG. 31, a sector gear 570 is rotatably connected to the drawbar rocker 550 at shaft 573. A pinion gear 576 rigidly secured to the shaft 581 engages the sector gear 570. During rotation of the crank disk 510, the pinion gear 576 is generally stationary relative to the frame of the apparatus 500. The sector gear 570 may therefore be more properly described as rolling about the stationary axis of pinion gear 576. Continuing now, a sector gear distant hub 562 is integrally rigidly connected to the sector gear 570 at a given radial distance from the sector gear rotational axis defined at shaft 573. A first distal end of a intermediate link 560 is rotatably connected to the handle bar rocker 540 at shaft 545, and a second distal end of the intermediate link 560 is rotatably connected to the sector gear distant hub 562. When adjusting the exercise apparatus for maximum stride length, the hand grip 580 is pulled rearward, thus rotating the pinion gear 576 in a counter-clock wise direction, and thereby advancing the sector gear 570 downward such that the sector gear distant hub 562 is moved further away from shaft 581. It will be observed that in this position the axis 563 of the hub 562 is coincident with the pitch diameter of the teeth of the sector gear 570. For a minimum stride length, hand grip 580 is pushed forward and thereby rotating the pinion gear 576 in a clock wise direction. Clock wise rotation of the pinion gear 576 advances the sector gear 570 upward so that the axis 563 of the hub 562 is moved closer to the shaft 581.

Figure 33:
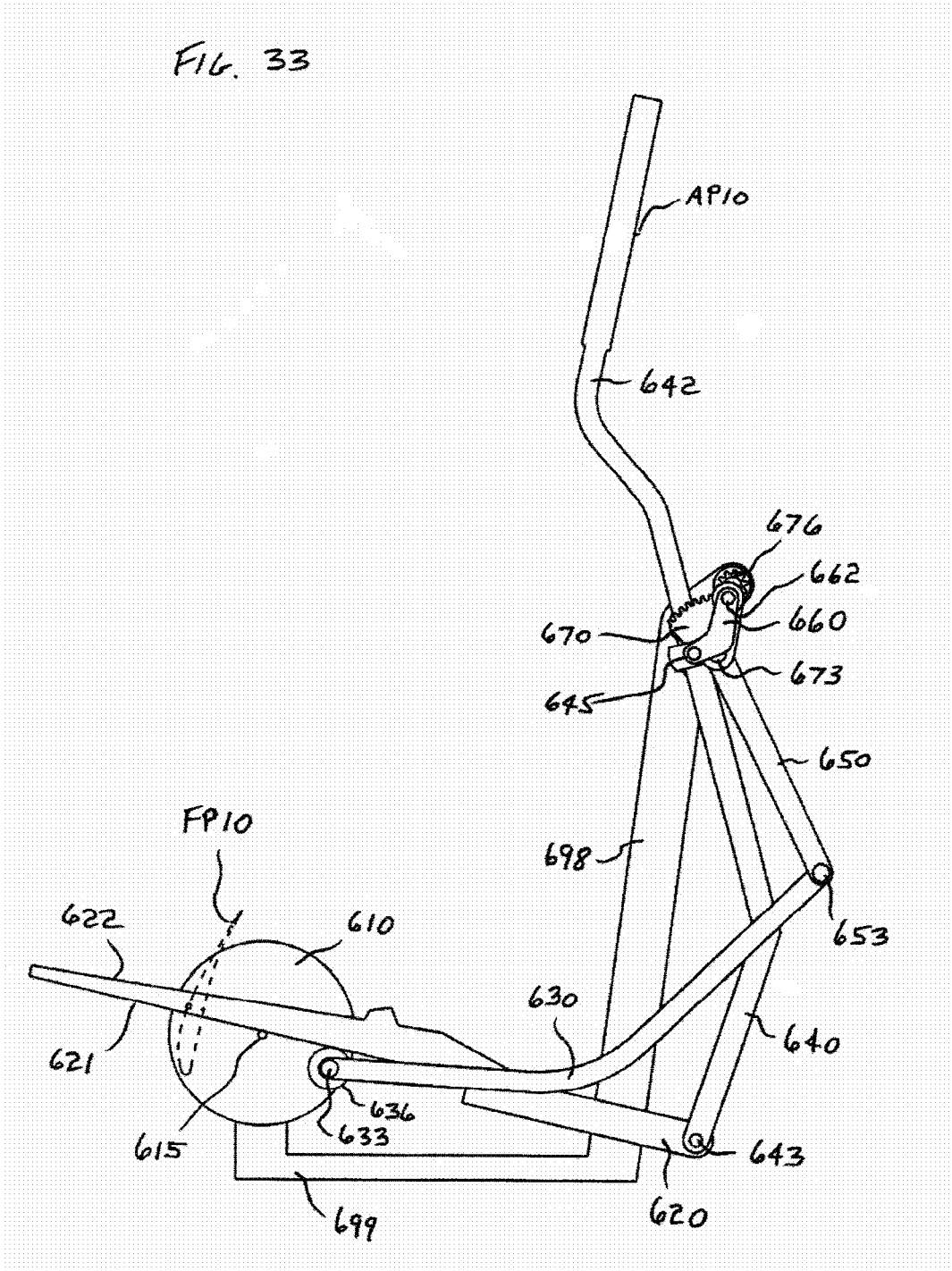
FIG. 33 is a side view of a sixth embodiment of the present invention adjusted for a minimum longitudinal foot path.
Figure 34:
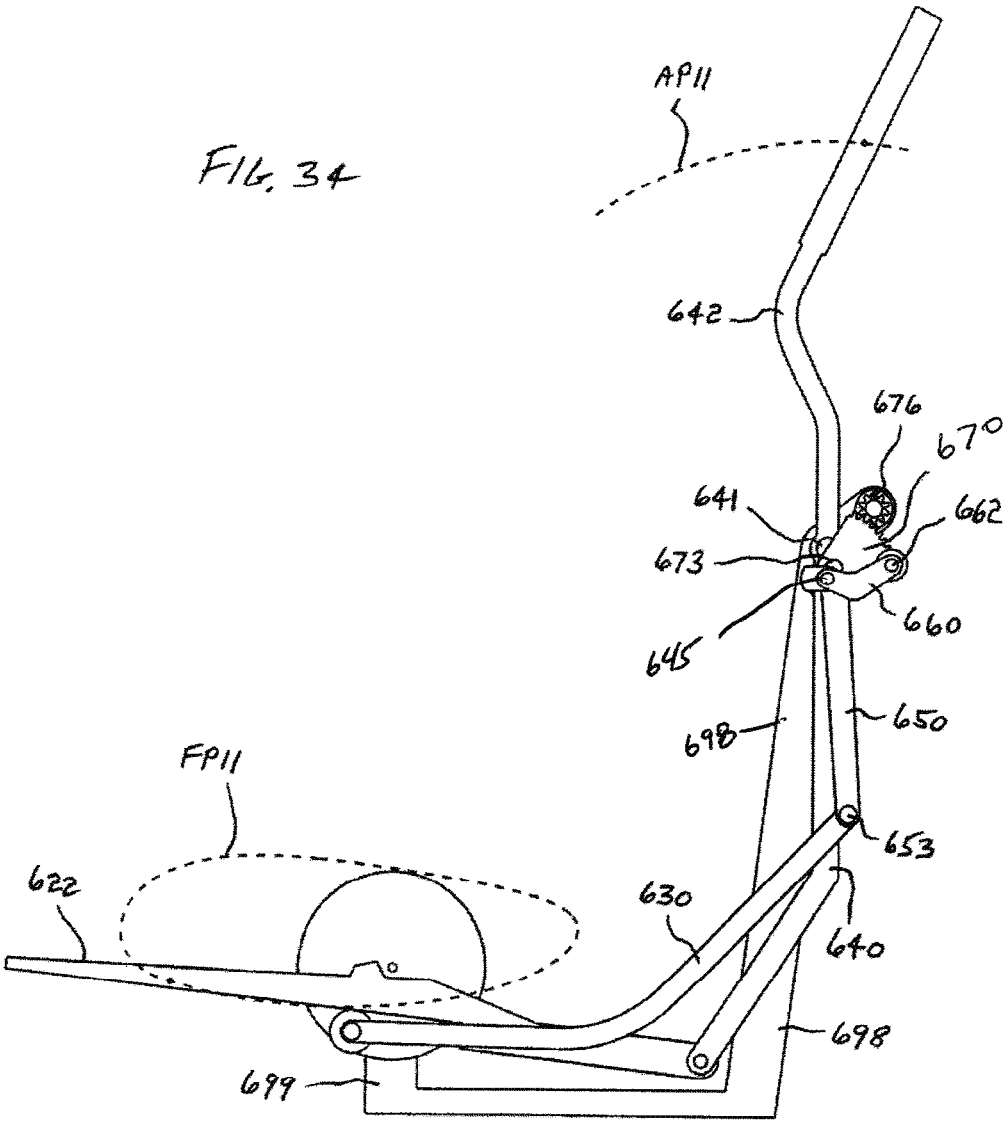
FIG. 34 is a side view of the exercise apparatus of FIG. 33 adjusted for a maximum longitudinal foot path.

Referring now to FIG. 33 and FIG. 34, a sixth embodiment of the present invention is generally identified by the reference numeral 600. The exercise apparatus 600 is substantially similar to the exercise apparatus 500 and the reference numerals of common components have been increase by 100. In FIG. 33, the exercise apparatus 600 is adjusted to guide a user's foot about a minimum longitudinal foot path FP10. In FIG. 34, the exercise apparatus 600 is adjusted to guide a user's foot through a maximum longitudinal foot path FP11. The frame stanchion 698 rotatably supports the handle bar rocker 640 at shaft 641. The drawbar rocker 650 is rotatably supported at a shaft concentric with the pinion gear 676. The sector gear 670 is rotatably connected to the handle bar rocker 640 at shaft 673. The intermediate link 660 is rotatably connected to the handle bar rocker 640 at shaft 645, and a second distal end of the intermediate link 660 is rotatably connected to the sector gear distant hub 662. The handle bar 642 is rigidly connected to the handle bar rocker 640, thus the arm path motion AP10 and AP11 is proportional to the path FP10 and FP11, respectively. Alternatively, the handle bar 642 may be rigidly connected (not shown in the drawings) to the drawbar rocker 650 if it is desired to establish constant range of motion of the handle bar 642 regardless of the magnitude of the foot path.

While preferred embodiments of the invention have been shown and described, other and further embodiments of the invention may be devised without departing from the basic scope thereof, and the scope thereof is determined by the claims which follow.

The invention claimed is:

1. A variable motion exercise apparatus, comprising:

a) a frame designed to rest upon a floor surface;

b) a left crank and a right crank, wherein each said crank is mounted on a respective side of said frame and rotatable about a common crank axis;

c) a left handle bar rocker link and a right handle bar rocker link, wherein each said handle bar rocker link is mounted on a respective side of said frame and rotatable about a common pivot axis;

d) a left foot support link and a right foot support link, wherein each said foot support link is movably connected between a respective said handle bar rocker link and a respective said crank; and e) a left drawbar linkage and a right drawbar linkage, wherein each said drawbar linkage includes a drawbar link and a drawbar rocker link pivotally connected to one another, wherein said drawbar link is movably connected between a respective said drawbar rocker link and a respective said crank in such a manner that a foot supporting portion of each said foot support link is constrained to move through a generally elliptical path as a respective said crank rotates, and a distal end of each said drawbar rocker link is pivotally connected to said frame at a first pivot axis; and f) wherein said drawbar linkage further includes a first intermediate link and a second intermediate link, a first end of each said first intermediate link is rotatably connected to a respective said handle bar rocker link, a first end of each said second intermediate link is pivotally connected to a respective said drawbar rocker link and wherein a second end of a respective said first intermediate link is pivotally connected to a second end of a respective said second intermediate link at a second pivot axis; and g) an actuator interconnected between a respective said second intermediate link and a respective said drawbar rocker link, wherein activation of said actuator adjusts the distance between said first pivot axis and said second pivot axis to alter a respective path.

* * * * *